US005490553A

United States Patent [19]

Colson et al.

[11] Patent Number: 5,490,553

[45] Date of Patent: Feb. 13, 1996

[54] FABRIC WINDOW COVERING WITH RIGIDIFIED VANES

[75] Inventors: Wendell B. Colson, Boulder, Colo.; Richard N. Anderson, Whitesville, Ky.; Paul G. Swiszcz, Boulder; Jason T. Throne, Broomfield, both of Colo.

[73] Assignee: Hunter Douglas, Inc., Upper Saddle River, N.J.

[21] Appl. No.: 149,315

[22] Filed: Nov. 9, 1993

[51] Int. Cl.[6] ..... E06B 9/06

[52] U.S. Cl. ..... 160/84.06; 160/89; 160/166.1

[58] Field of Search ..... 160/84.1, 89, 166.1, 160/168.1 R, 236; 156/308.2, 302; 428/116, 118, 188

[56] References Cited

U.S. PATENT DOCUMENTS

| | | | |
|---|---|---|---|
| 1,937,342 | 11/1933 | Higbie | 160/84.01 X |
| 2,110,145 | 3/1938 | Loehr | 160/89 |
| 2,267,869 | 12/1941 | Loehr | 160/89 |
| 2,577,227 | 12/1951 | Brent . | |
| 2,667,218 | 1/1954 | Collins | 160/84.04 |
| 2,802,522 | 8/1957 | Collet | 160/84.04 |
| 2,829,081 | 4/1958 | Sweem | 160/84.01 X |
| 2,865,446 | 12/1958 | Cole . | |
| 2,894,573 | 7/1959 | Rosenfeld | 160/84.04 |
| 2,914,122 | 11/1959 | Pinto | 160/89 |
| 2,994,370 | 8/1961 | Pinto . | |
| 3,384,519 | 5/1968 | Froget . | |
| 3,844,330 | 10/1974 | Hyman | 160/84.01 X |
| 3,851,699 | 12/1974 | Shapiro | 160/900 X |
| 4,019,554 | 4/1977 | Rasmussen | 160/166.1 R X |
| 4,309,472 | 1/1982 | Gotting et al. . | |
| 4,450,027 | 5/1984 | Colson . | |
| 4,535,828 | 8/1985 | Brockhaus . | |
| 4,724,883 | 2/1988 | Liebowitz . | |
| 4,732,630 | 3/1988 | Schnebly . | |
| 4,884,612 | 12/1989 | Schnebly et al. | 160/89 X |
| 4,928,369 | 5/1990 | Schnebly . | |
| 5,205,891 | 4/1993 | Neff | 160/84.01 X |
| 5,320,154 | 6/1994 | Colson et al. | 160/121.1 |
| 5,349,730 | 9/1994 | Anderson et al. . | |

FOREIGN PATENT DOCUMENTS

| | | |
|---|---|---|
| 249985 | 3/1961 | Australia . |
| 1309194 | 11/1962 | France . |
| 1364674 | 7/1964 | France . |
| 1465261 | 4/1966 | France . |
| 1521488 | 3/1968 | France . |
| 7008554 | 12/1971 | Germany . |
| 3525515 | 2/1987 | Germany . |
| 1494842 | 4/1977 | United Kingdom . |

*Primary Examiner*—Blair M. Johnson
*Attorney, Agent, or Firm*—Gary M. Polumbus; Holland & Hart

[57] ABSTRACT

A window covering is described wherein at least one translucent or transparent sheet is suspended vertically and has a plurality of parallel vanes projecting rearwardly therefrom. The vanes are formed from fabric material which has either been rigidified with a rigidifying compound or rigidified by the formation of a pocket into which a rigid slat is inserted. Variations are provided for varying the flexibility of a hinge defined along a juncture line between the vanes and the fabric sheet.

23 Claims, 21 Drawing Sheets

216

Fig_53
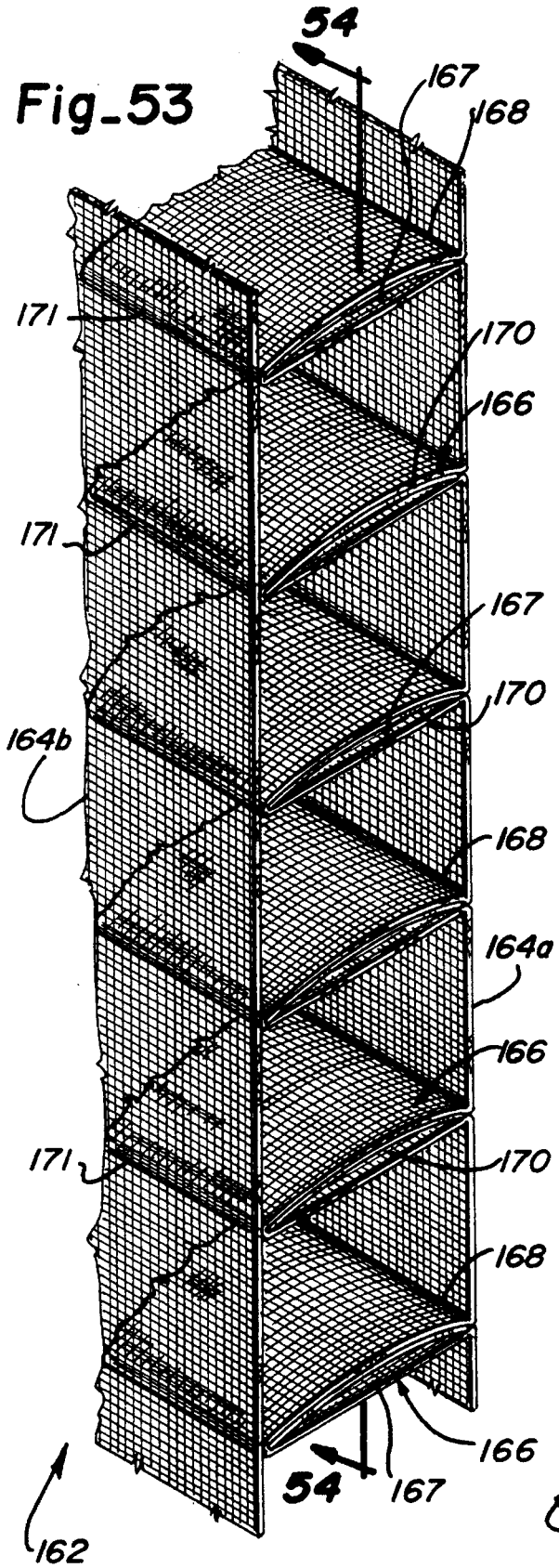
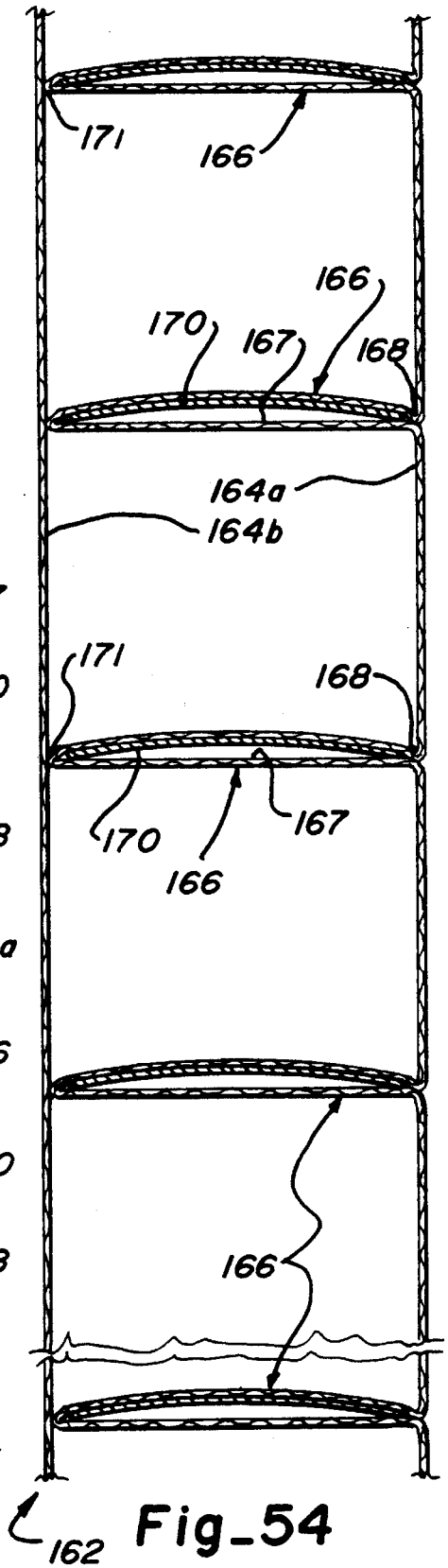
Fig_54

Fig_55
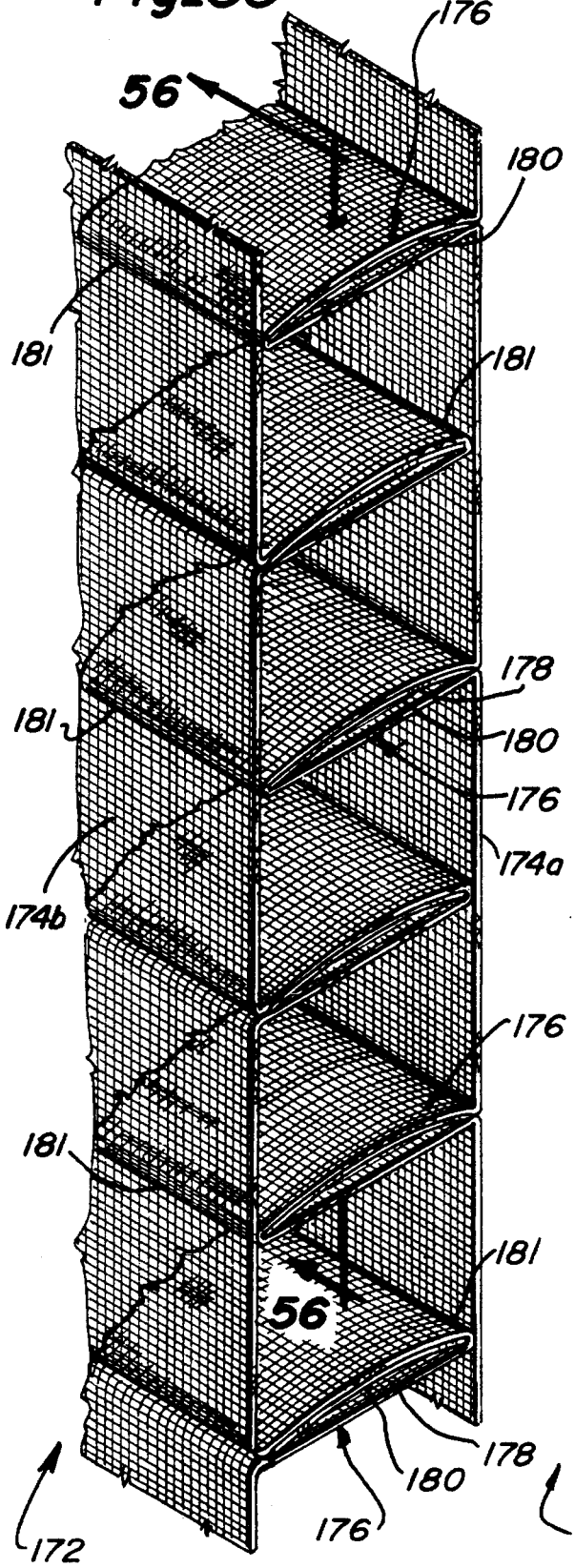
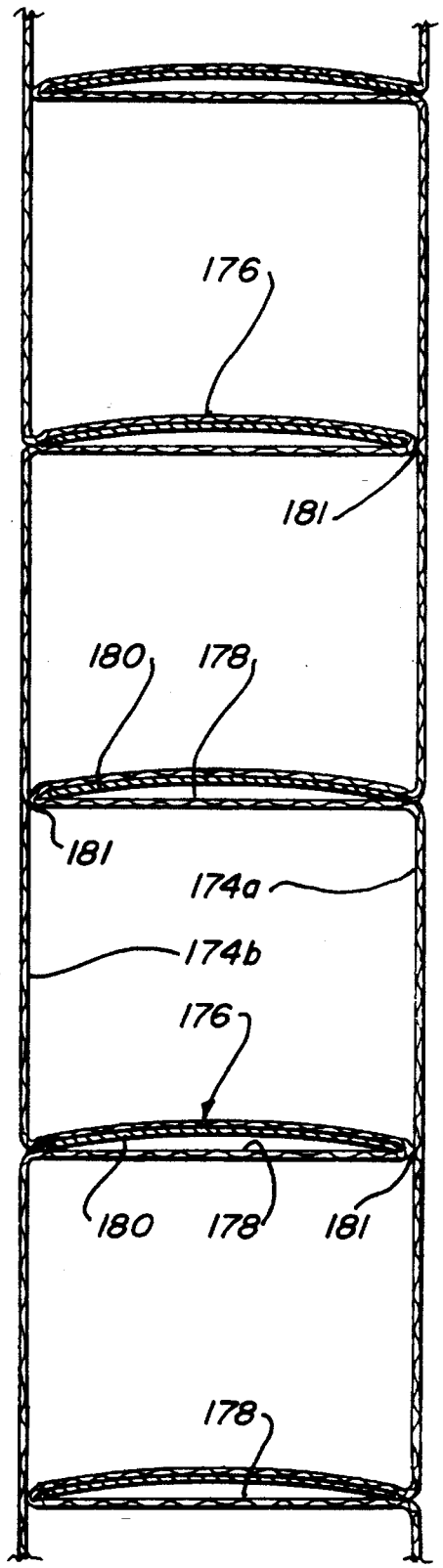
Fig_56

FABRIC WINDOW COVERING WITH RIGIDIFIED VANES

BACKGROUND OF THE INVENTION

1. The Field of the Invention

The present invention relates generally to window coverings and more particularly to window coverings including a transparent or translucent sheet to which is flexibly attached a plurality of rigidified parallel vanes.

2. Description of the Prior Art

Fabric window coverings are often preferred by consumers for a number of their features. Features most often considered desirable are the softer appearance relative to traditional venetian blinds, the uniform appearance which they provide a window and insulating properties associated with cellular fabric shades.

Cellular fabric shades offering these features are known in the art. For example, U.S. Pat. No. 4,450,027 to Colson discloses cellular window coverings which may be made of fabric or fill materials. In the process disclosed in the Colson patent, a flexible strip of material is folded into a continuous longitudinal tube and the longitudinal folds thus created are currently set by passing the tubing material around a heat setting wheel. Adhesive is applied along one side of the flattened tubular material which is subsequently stacked by winding onto a rack having flat surfaces. The winding in this manner presses the adhesive to the next layer wound onto the rack to form a bonded unitary stack of closed tubular cells. When the ends are cut from the rack, the stack may be expanded and the permanently set creases provide a neat and uniform outward appearance.

U.S. Pat. No. 4,732,630 to Schnebley discloses a modification to the Colson process described above. In the Schnebley patent, a hot melt adhesive is applied to one side of the tubular material. After the flat tubular strips have been stacked and cut, they are placed in an oven under pressure and the hot melted adhesive is activated to bond the layers together.

Both of the above patents disclose window coverings which exhibit the desirable features discussed to this point. However, window coverings of that type lack one feature which is often desired by consumers. That feature is the ability to control the amount of light admitted through the window covering, similar to a traditional venetian blind. There have been some attempts to provide a fabric window covering with the ability to control the amount of light entering the room.

U.S. Pat. No. 3,384,519 to Froget discloses one such attempt. The window covering disclosed therein consists of two cloth layers spaced apart by moveable, parallel and flexible fabric blades having each of their marginal edges heat welded to one of the moveable cloth layers. With this window covering, relative movement of the two cloth layers in opposite directions changes the angle of the blades and thus controls the amount of light admitted through the covering. A number of undesirable features of the Froget window covering derive from the fact that it is constructed utilizing a heat welding process. First, this limits the fabric which may be utilized to thermoplastic materials. Also, heat welding necessarily requires a melting of at least some of the fibers of the materials bonded, thus providing an uneven outer appearance along the heat weld and producing unwanted crimps or creases in the materials which can result in failure of the fabric fibers. Further, heat welding is a relatively slow process which may require six or more seconds to create a bond over an extended length. This is too slow for application in high volume commercial production processes. Other drawbacks of the Froget window covering are that heat welds are limited in strength and it is difficult to achieve uniformly straight heat welded points over an extended length. French Patent No. 1,364,674 also issued to Froget discloses a similar window covering with the same general limitations.

U.S. Pat. No. 2,865,446 to Cole discloses a window covering in which a long rectangular piece of fabric is doubled back upon itself and a plurality of pleated elements are placed between the folded over sheets. The pleated elements are an accordion pleated fabric which extends when the two sides of the folded over fabric are moved relative to one another in a direction perpendicular to the accordion pleats. Such a window covering does not provide a uniform appearance because the accordion pleated fabric located close to the top of the window covering does not expand to the same extent as the fabric closer to the bottom of the window covering. Also, it is very difficult to insure that such accordion pleated fabric returns to its desired position after each expansion.

French Patent No. 1,309,194 discloses a curtain with variable opacity. In this curtain, screen or mesh parallel sides are provided with tiltable braids therebetween. The braids are said to be attached at their edges to the sides. However, no means for attachment is specified. The drawings appear to indicate a hinge type attachment and the specification ends by stating that the difficulties of construction are substantial.

U.S. Pat. No. 4,535,828 issued to Brockhaus shows a window insulator wherein a sheet of insulating material having encapsulated bubbles is appropriately slit and folded upon itself to form pivotal vanes. The insulating material is of the type commonly used as a stuffer in packaging. The vanes are supported along one edge by the sheet of material from which they are formed and along an opposite edge by flexible strands.

A venetian blind type window covering is disclosed in U.S. Pat. No. 2,577,227 issued to Brent. The Brent window covering incorporates a pair of flexible straps which have been folded upon themselves at spaced locations to form supports or pockets for slats which are pivotal by movement of the straps. The free edge of each folded portion of the straps are supported by other similar strapping.

U.S. Pat. No. 4,309,472 to Gotting et al. discloses a window covering having vertically extending vanes which have been independently made from synthetic fabric that has been stiffened in a thermal process. The vanes are suspended from their upper ends and manipulated in a conventional manner.

Great Britain Patent No. 1,494,842 discloses a window covering wherein a thermoplastic film or the like is forced into a corrugated configuration and then heat sealed to form envelope strips into which are inserted metal foil or the like. Various modifications are disclosed in the patent with means being provided to support the free edges of the envelopes so that they can be selectively pivoted to open and close the window covering.

German Patent No. DE3525515A1 issued to Moser discloses another window covering formed from two sheets of material having parallel vanes therebetween. The vanes are formed by gathering one of the sheets and folding it upon itself at spaced locations. The sheets are sewn together along the folds to form pockets. Strips of material can be inserted into the pockets for added stiffness.

Another patent disclosing a window covering with parallel vanes disposed between parallel sheets is U.S. Pat. No. 1,937,342 issued to Higbie. The vanes in the Higbie covering are formed from loops gathered from both sheets and define pockets for the receipt of more rigid slats.

French Patent No. 1,465,261 to Mollard very broadly and sketchedly describes an ensemble that includes a transparent panel to which is flexibly attached a multiplicity of elements which are opaque. The elements are affixed along one edge to the transparent panel as by gluing, sewing, soldering, stapling, etc. Cords or bands are attached to the opposite edges of the elements to pivot them about their attachment to the transparent panel. The patent is not written in very much detail as to the elements themselves. The patent also discloses an alternative embodiment wherein the transparent panel is pleated and lined or otherwise coated with an opaque glue or band in place of the elements of the first-described embodiment.

U.S. Pat. No. 3,851,699 issued to Shapiro discloses a vertical louver type window drape wherein a continuous sheet of fabric material is interwoven with a plurality of relatively rigid vanes such that the vanes which are light impeding alternate with light transmitting sections of the fabric. One obvious drawback of a system of this type is that the vanes overlap the fabric requiring excessive fabric in order to fabricate the entire window covering. Further, the vanes or louvers are only attached to the fabric material along a top and bottom edge thereof, thereby inhibiting the control over the fabric material during operation of the window covering.

Window coverings of the afore-noted type, as mentioned previously, are desirable from several viewpoints. It has also been discovered that variations in this general type of window covering may be desirable from many standpoints, both utilitarian and aesthetic. It is to provide alternatives and improvements to the afore-described prior art systems that the present window covering has been developed.

SUMMARY OF THE INVENTION

The window covering of the present invention is of the type that includes at least one transparent or translucent sheet and a plurality of rigid vanes flexibly integrated therewith. The vanes and or sheet are supported by a control system which is operative in pivoting the vanes between an open position wherein they extend substantially perpendicularly to the sheet and a closed position wherein they extend in a substantially parallel relationship with the sheet.

In one embodiment of the invention, horizontal vanes are formed by gathering elongated loops of material off the rear face of the fabric sheet and rigidifying the looped fabric with a stiffening compound so that the rigidified fabric defines the vanes. Juncture lines are defined where the vanes merge into the sheet. Various means for rendering the juncture lines more flexible include compressing the fabric along the juncture line or providing spaced elongated slots along the juncture line. In a variation where the vanes are not actually gathered from the sheet but formed separately from a fabric material, this juncture line can be rendered more flexible by making the vanes of a single layer along the juncture line or utilizing a relatively thin flexible ribbon like connector to join the vanes to the sheet.

The rigidified looped fabric forming the vanes in some embodiments includes two layers which may be bonded together into a two layer laminate or may be formed into a hollow tubular configuration wherein the tubular configuration lends structural rigidity to the vane in addition to the rigidity provided by the stiffening compound.

In a second embodiment of the invention, the fabric sheet is gathered at uniformly spaced locations so that loops of the fabric are formed off a rear face of the fabric sheet and the fabric is bonded together but only along longitudinal juncture lines where the looped fabric vanes merge with the sheet. The loops can be formed separately from the sheet but preferably they are formed integrally with the sheet. The looped fabric defines horizontally-extending pockets into which rigid slats are inserted to provide the rigidity desired for the vanes. The fabric sheet and vanes are suspended with a control system that enables the vanes to be pivoted between an open position wherein they extend substantially perpendicularly to the sheet and a closed position wherein they extend substantially parallel to the sheet.

A conventional venetian blind control system can be utilized wherein a plurality of support cords are interconnected to the vanes at longitudinally spaced locations and are manipulated by pull cords to shift the vanes between the open and closed conditions. Other arrangements may also be employed such as replacing the support cords with a set of single cords connected to a rear edge of the vanes and shifting the cords reciprocally relative to the sheet so as to manipulate the angular position of the vanes. In lieu of the set of single cords, a second sheet can be affixed to the rear edge of the vanes such that a control system reciprocally shifts the front sheet relative to the rear sheet thereby pivoting the vanes between the open and closed position.

The vanes in either embodiment can also be vertically suspended by carriers which can be pivoted with a control system to pivot the vanes about longitudinal vertical axes thereby moving the vanes between the open and closed positions.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 53 is a fragmentary isometric of an eleventh arrangement of the first embodiment of the present invention with the vanes in an open position.

FIG. 54 is an enlarged fragmentary section taken along line 54—54 of FIG. 53.

FIG. 55 is a fragmentary isometric of a twelfth arrangement of the first embodiment of the present invention with the vanes in an open position.

FIG. 56 is an enlarged section taken along line 56—56 of FIG. 55.

DESCRIPTION OF THE PREFERRED EMBODIMENTS

Figure 1:
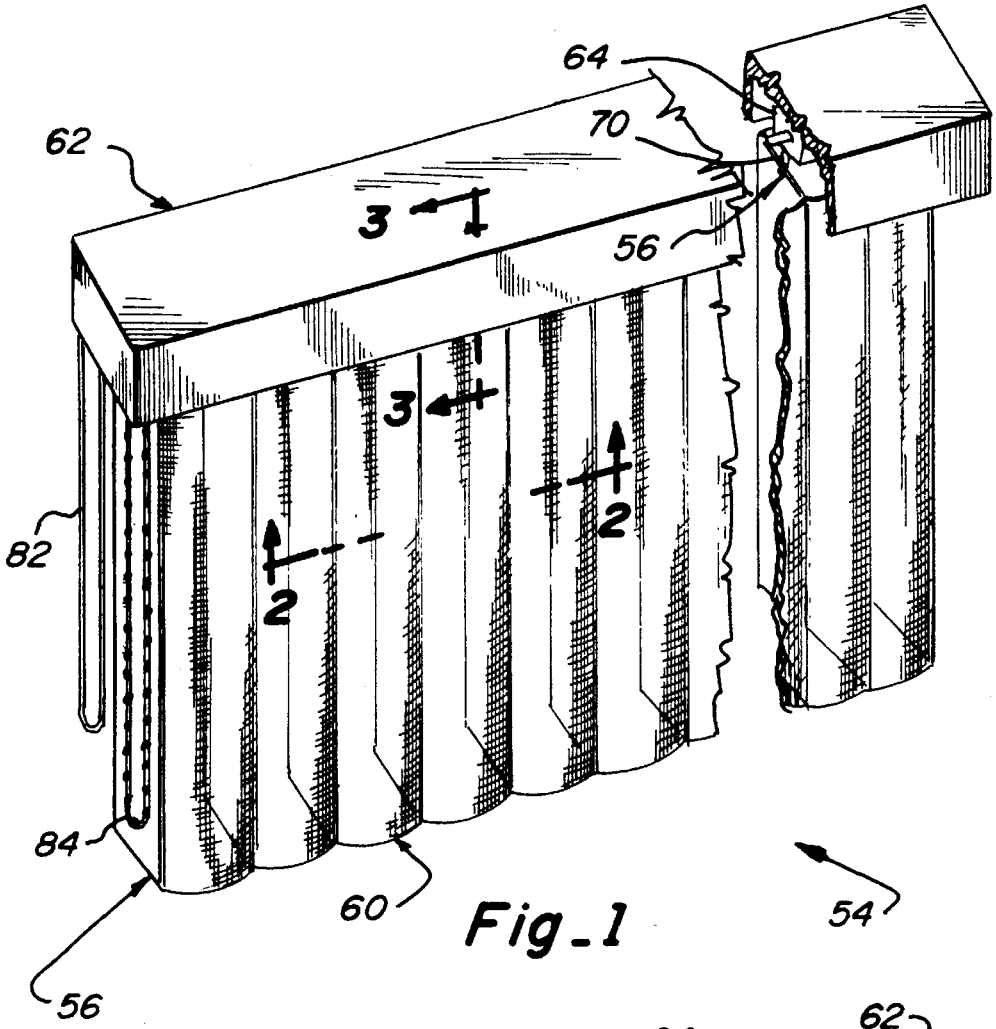
FIG. 1 is a fragmentary isometric view of a first embodiment of the window covering of the present invention.

A first arrangement of a first embodiment of the window covering of the present invention is illustrated in FIGS. 1–11. In FIG. 1, the window covering 54 can be seen to include a plurality of vertically extending vanes 56 formed off a rear face 58 of a fabric sheet 60. The vanes 56 are suspended from a head rail 62 containing a control system 64 which may be of the general type described in U.S. Pat. No. 4,724,883 which is hereby incorporated by reference. The fabric sheet 60 is preferably made of a transparent or translucent material such as sheer.

The vanes 56 are formed integrally with a virgin sheet of such fabric by vertically gathering the virgin sheet at horizontally spaced locations so as to form a plurality of equally spaced elongated loops 66 of fabric extending off a rear face of the sheet. The term "virgin sheet" is used herein to designate the piece of fabric material from which both the vanes 56 and the fabric sheet 60 itself are formed. The term "fabric sheet" herein designates the sheet like component of the completed window covering.

The loops 66 of fabric have two layers which are then integrated together into a flat planar laminated form with a stiffening compound 68 so as to substantially rigidify the vanes relative to the soft fabric material from which the sheet 60 is made. An example of a stiffening compound which has been found suitable for the purpose is manufactured by Rohm & Haas of Philadelphia, Pa. and marketed under type HA-16. Preferably, the double layered loops 66 of fabric and the stiffening compound 68 which together comprise the vanes 56 have some degree of opacity for reasons to be discussed hereafter.

Figure 2:
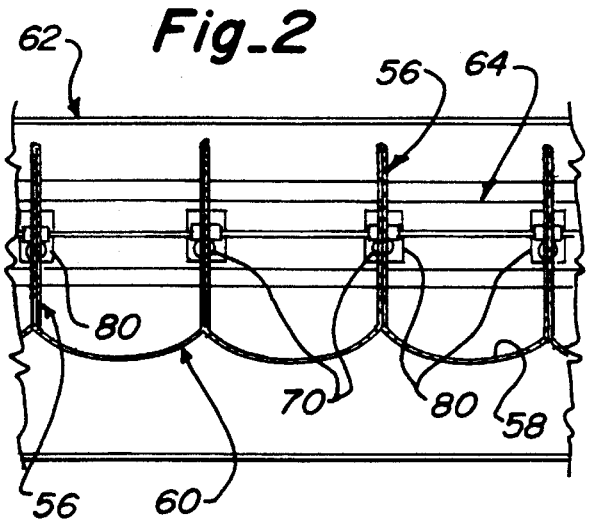
FIG. 2 is an enlarged fragmentary section taken along line 2—2 of FIG. 1.
Figure 3:
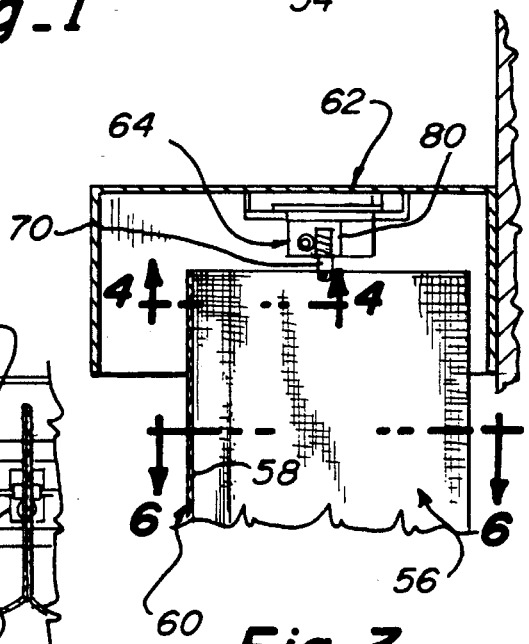
FIG. 3 is an enlarged fragmentary section taken along line 3—3 of FIG. 1.
Figure 4:
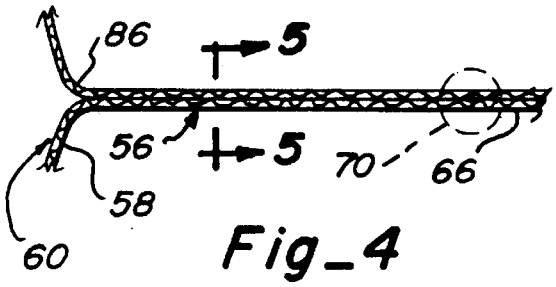
FIG. 4 is a further enlarged fragmentary section taken along line 4—4 of FIG. 3.
Figure 7:
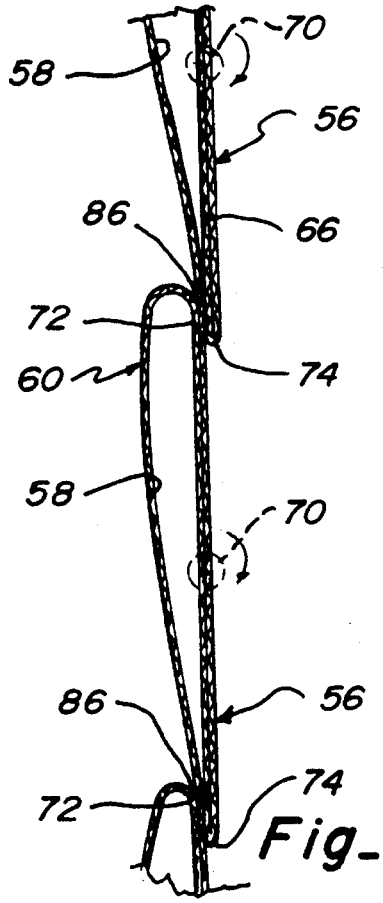
FIG. 7 is a fragmentary horizontal section showing the vanes in the closed condition of the window covering.
Figure 9:
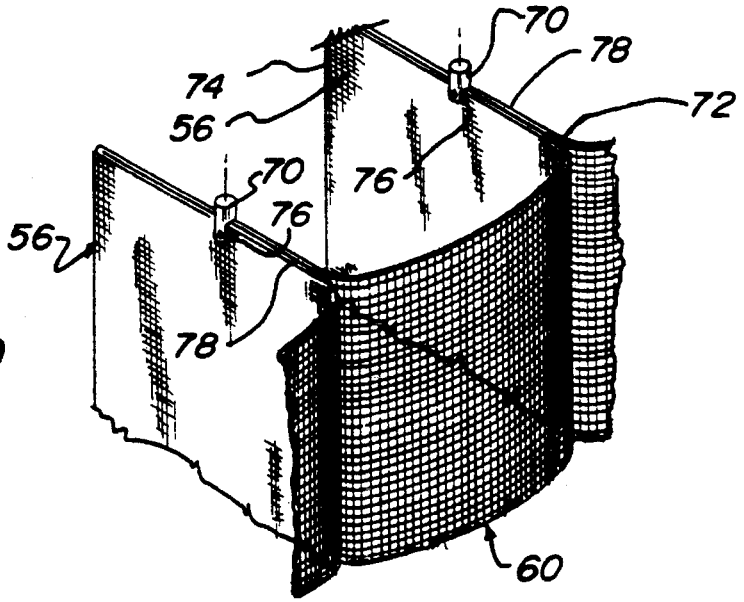
FIG. 9 is a fragmentary isometric view showing two vanes and the sheet in an open condition.

The substantially rigidified vanes 56 retain their flat planar form and are connected to vertical pivot shafts 70 at their top end at a location intermediate the front and rear edges 72 and 74 respectively of the vane. The pivot shafts 70 may be connected to the vanes in any suitable manner but preferably the shafts are provided with a notch 76 at their lower end, as best seen in FIG. 9, so as to straddle the top edge 78 of the associated vane and then pinned to the vane. The shafts 70 are suspended from carriers 80 that are slidably positioned within the head rail 62 and moveable transversely of the window covering by a control cord 82. A second control cord 84 rotates the shafts 70 through the carriers 80 so that the vanes can be pivoted about longitudinal vertical axes extending through the shafts 70 between an open position wherein they extend substantially perpendicularly to the sheet 60 as illustrated in FIG. 2 and a closed position wherein they lie in substantially parallel relationship with the sheet as illustrated in FIG. 7. Due to the opacity of the vanes, when they are in the closed position of FIG. 7, they substantially block the passage of light and vision through the window covering. The carriers 80 may be of the type disclosed in the aforementioned U.S. Pat. No. 4,724,883.

Figure 5:
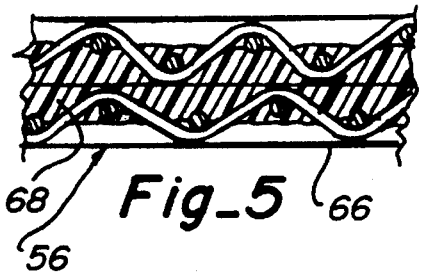
FIG. 5 is yet a further enlarged section taken along line 5—5 of FIG. 4.
Figure 6A:
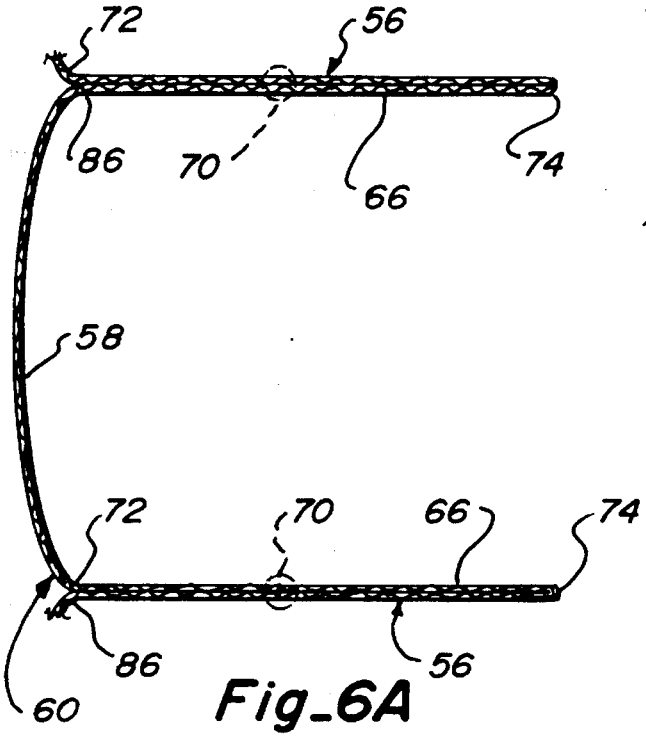
FIG. 6A is an enlarged fragmentary section taken along line 6—6 of FIG. 3.
Figure 8:
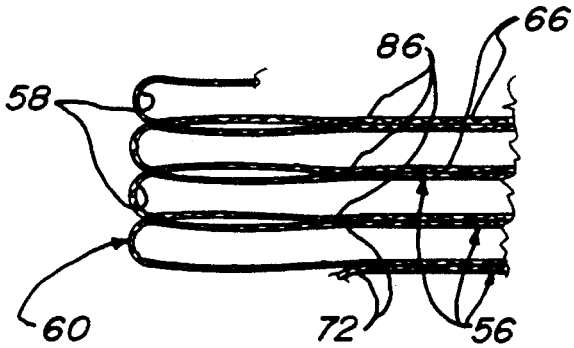
FIG. 8 is a fragmentary horizontal section showing the vanes in the open condition of the window covering and with the vanes shifted into closely adjacent side-by-side relationship.

FIG. 5 is a cross sectional view through a vane 56 formed in accordance with the above described procedure and it will be appreciated that the stiffening compound 68 penetrates both layers of the fabric vanes. If carefully selected quantities of the compound are utilized, however, the compound does not have to totally impregnate the fabric thereby leaving relatively soft outer surfaces on both sides of the vane. FIGS. 6–8 respectively show the relationship of the vanes 56 to the fabric sheet 60 in an open condition, a closed condition and an open condition wherein the vanes have been shifted to one side of a window opening (not shown) in closely adjacent relationship.

Figure 10:
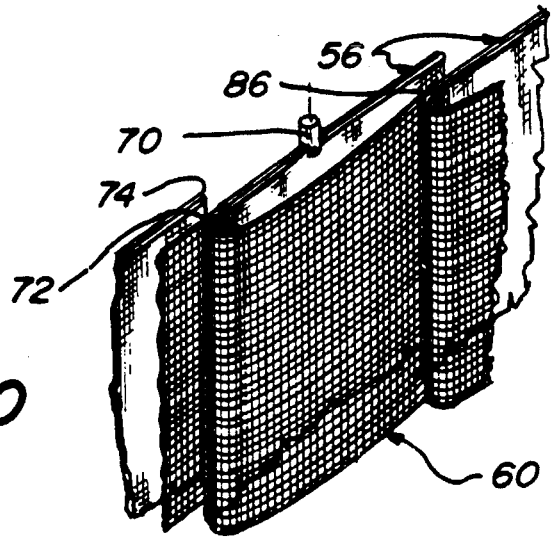
FIG. 10 is a fragmentary isometric view similar to FIG. 9 with the vanes in a closed position.
Figure 11:
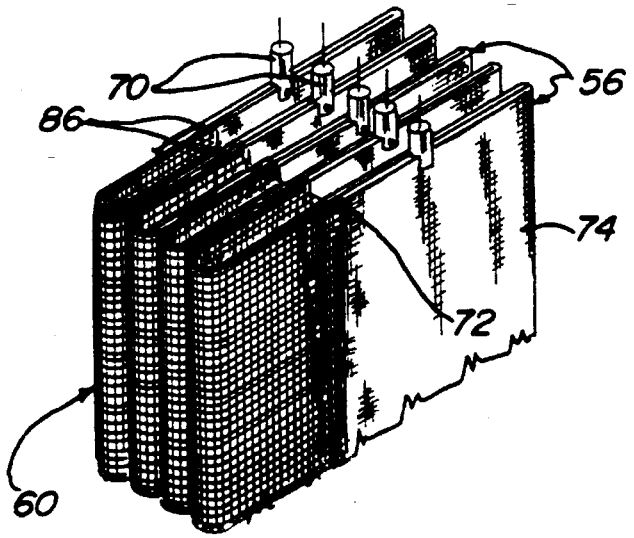
FIG. 11 is a fragmentary isometric view showing the vanes in an open position and moved into closely adjacent side by side relationship.

FIGS. 9–11 are isometric views corresponding with FIGS. 6–8 respectively giving a better feel for the aesthetics of the window covering 54 in the three identified positions.

Figure 12:
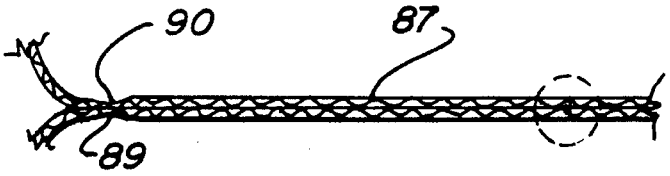
FIG. 12 is a transverse fragmentary section taken through a vane in a second arrangement of the first embodiment of the invention showing a compressed juncture line between the vane and the fabric sheet.
Figure 13:
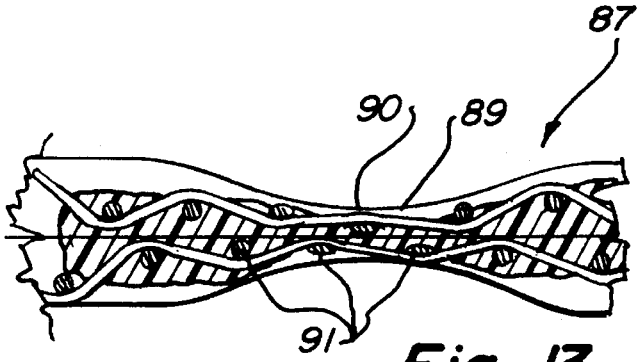
FIG. 13 is an enlarged fragmentary transverse section showing the juncture line between the vane and the sheet.

It will be appreciated that natural living hinges or juncture lines 86 are established along the front edge 72 of the vanes at the junctures of the vanes 56 with the relatively soft fabric sheet 60 so that the vanes can be pivoted relative to the sheet while retaining the sheet in a substantially vertical orientation. To enhance the flexibility of the window covering along the juncture lines between the vanes and the fabric sheet, the vanes 87 in a second arrangement 88 of the first embodiment are compressed as illustrated in FIGS. 12 and 13 along juncture lines 89. The compression indicated by reference numeral 90 collapses the fibers 91 in the fabric rendering the juncture line 89 relatively thin and more flexible than if the juncture line had not been compressed.

Figure 14:
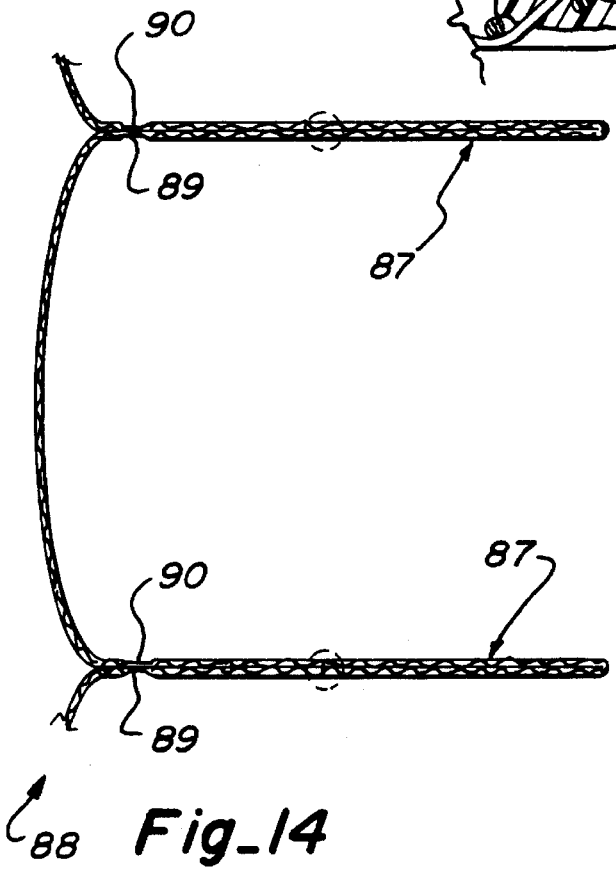
FIG. 14 is a fragmentary transverse section showing two adjacent vanes in an open condition and in accordance with the arrangement shown in FIGS. 12 and 13.
Figure 15:
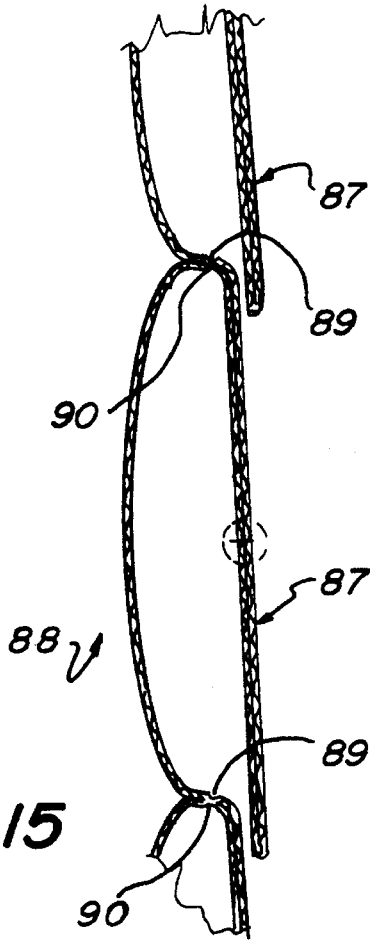
FIG. 15 is a fragmentary section similar to FIG. 14 with the vanes in a closed condition.
Figure 16:
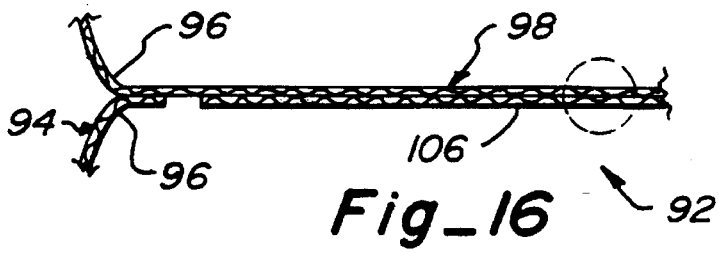
FIG. 16 is a transverse fragmentary section taken through a vane illustrating a third arrangement of the first embodiment of the invention.

FIGS. 14 and 15 illustrate this second arrangement 88 of the first embodiment of the present invention with the vanes 87 in an open condition and a closed condition respectively.

Figure 17:
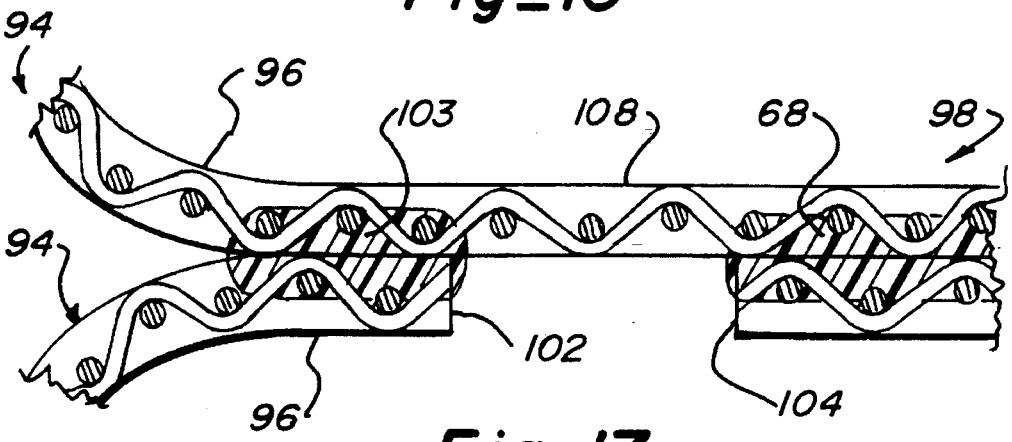
FIG. 17 is an enlarged fragmentary section similar to FIG. 16 showing the juncture line between the vane and the sheet.
Figure 18:
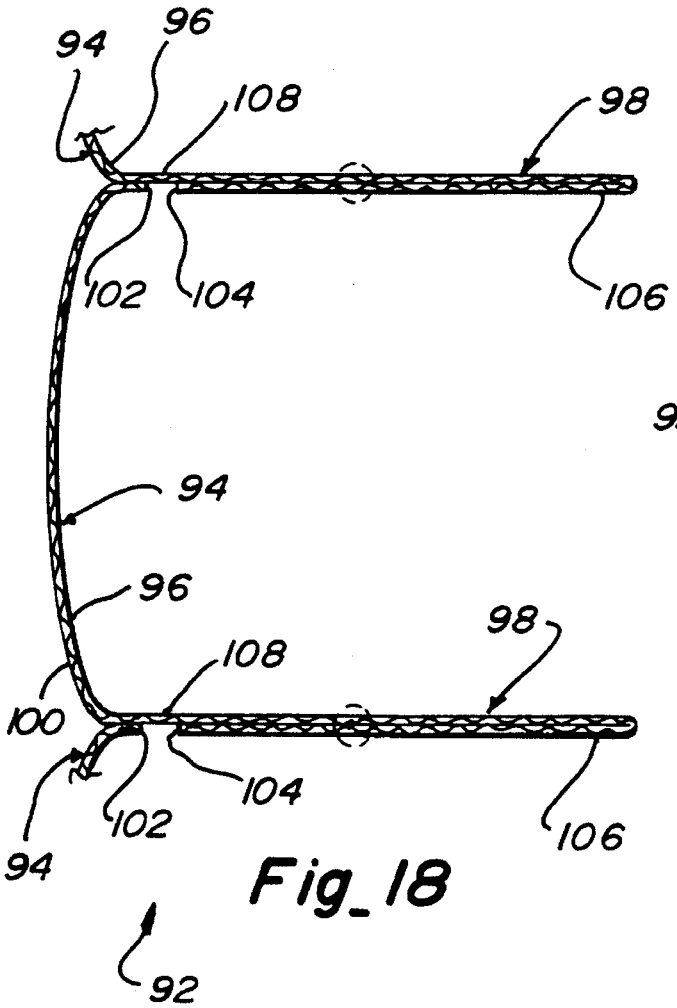
FIG. 18 is a fragmentary transverse section showing two vanes in an open condition fabricated in accordance with FIGS. 16 and 17.
Figure 19:
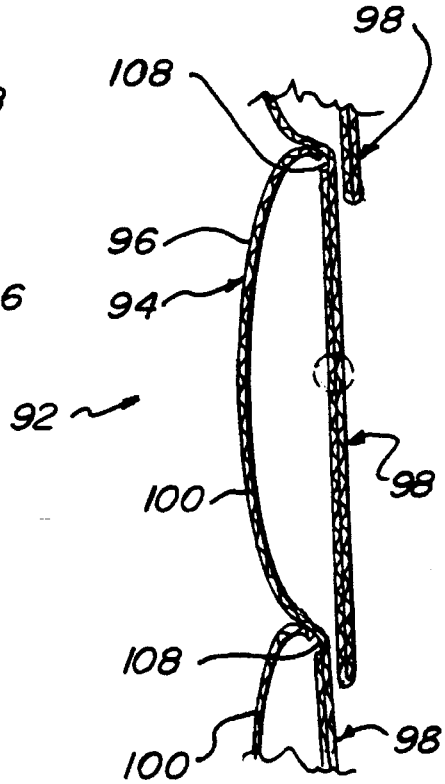
FIG. 19 is a fragmentary section similar to FIG. 18 with the vanes in a closed condition.

A third arrangement 92 of the first embodiment of the present invention is illustrated in FIGS. 16–19. In this arrangement, the fabric sheet 94 is formed from integrated or bonded strips 96 of the same fabric material with the strips extending vertically and being interconnected to establish double layered vanes 98 formed from the same fabric. As is best illustrated in FIGS. 18 and 19, a front face 100 of each strip 96 is connected along one vertically extending edge 102 to the front face of an intermediate location on a next adjacent strip with a bonding medium 103 and its opposite vertically extending edge 104 is folded upon itself so as to form a loop 106, the layers of which are integrated with the stiffening compound 68 as in the first described arrangement 54 of the first embodiment. The vertically extending adjacent edges 102 and 104 of adjacent strips 96 are spaced slightly to define a single layer juncture line or living hinge 108 between the vanes 98 and the sheet 94. The single layer juncture line of course is more readily flexed than a double layer. FIG. 17 shows an enlarged section of the juncture between adjacent strips 96 illustrating the regions in which the stiffening compound 68 is applied and the single layer juncture line 108 between the vanes and the sheet where no stiffening compound is used.

Figure 20:
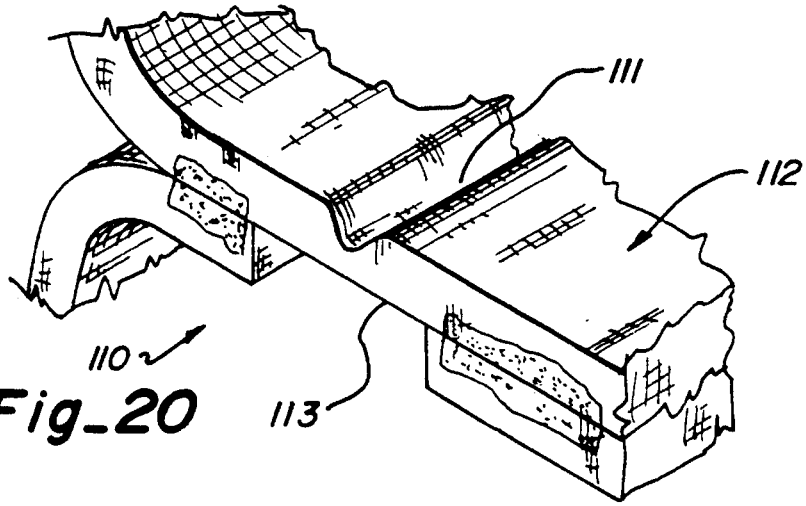
FIG. 20 is an enlarged fragmentary isometric view showing a fourth arrangement of the first embodiment of the present invention.

FIG. 20 shows a fourth arrangement 110 of the first embodiment of the window covering of the present invention with this arrangement being very similar to that shown in FIGS. 16–19 but wherein a crease 111 is formed in the single layer of vanes 112 along a juncture line 113 so as to render the juncture line even more flexible. The crease can be made by compressing the fabric material or in the case of synthetics, the material can be heat creased along the juncture line.

Figure 21:
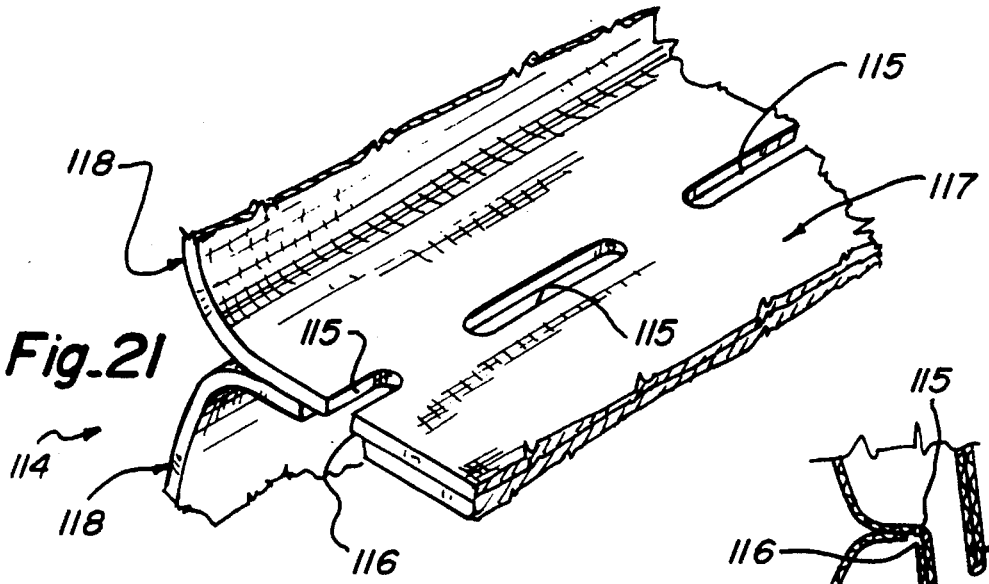
FIG. 21 is an enlarged fragmentary isometric view similar to FIG. 20 showing a fifth arrangement of the first embodiment of the present invention.

FIG. 21 shows a fifth arrangement 114 of the first embodiment of the present invention with this arrangement being very similar to that shown in FIGS. 16–19 but wherein a plurality of spaced elongated slots 115 are provided along a juncture line 116 between a vane 117 and an attached sheet 118 as illustrated in FIGS. 16–19. The slots again render the juncture line more flexible than the arrangement shown in FIGS. 16–19.

Figure 23:
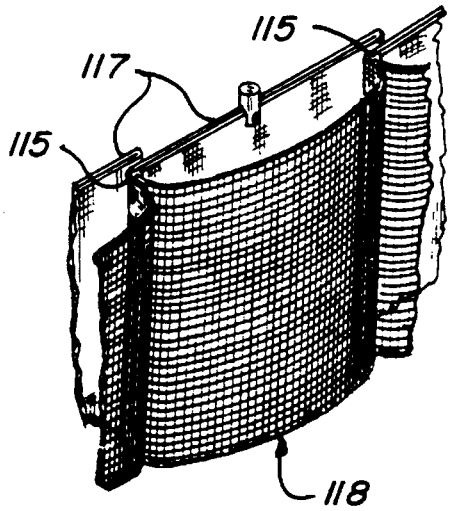
FIG. 23 is a fragmentary isometric view of the arrangement shown in FIGS. 21 and 22 with the vanes in a closed condition.
Figure 22:
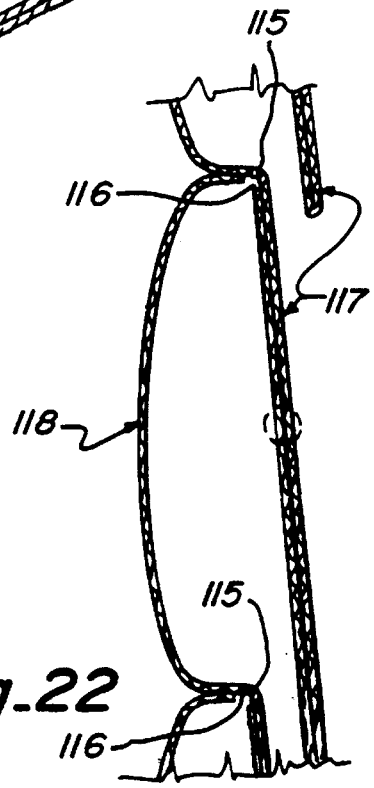
FIG. 22 is a fragmentary transverse section showing the vanes of the arrangement illustrated in FIG. 21 in a closed condition.

FIGS. 22 and 23 are sectional and isometric views respectively of the arrangement shown in FIG. 21 showing the relationship of the vanes 117 to the integrated strips of sheet material.

Figure 24:
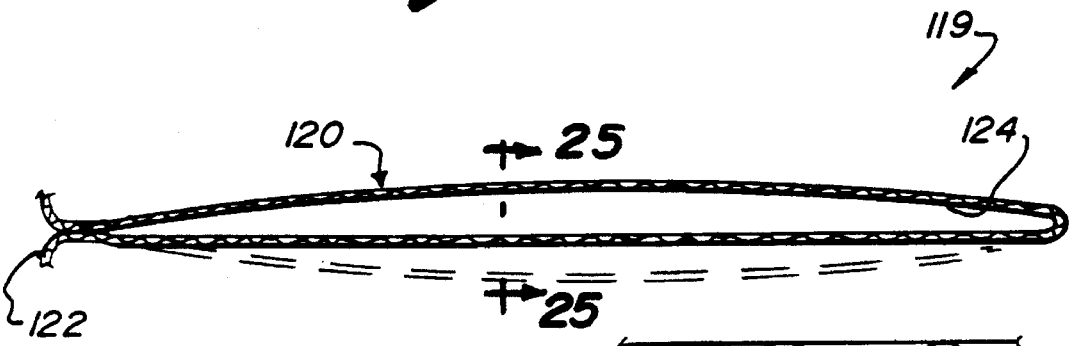
FIG. 24 is an enlarged fragmentary transverse section taken through a sixth arrangement of the first embodiment of the present invention.
Figure 25:
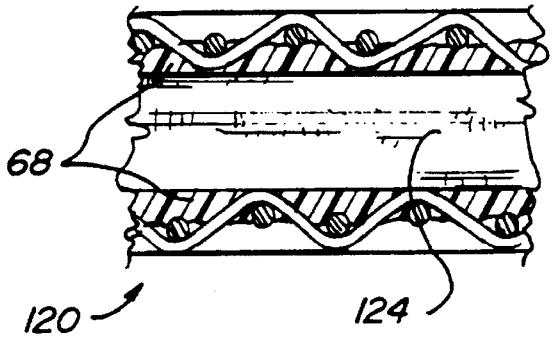
FIG. 25 is an enlarged fragmentary section taken along line 25—25 of FIG. 24.
Figure 28:
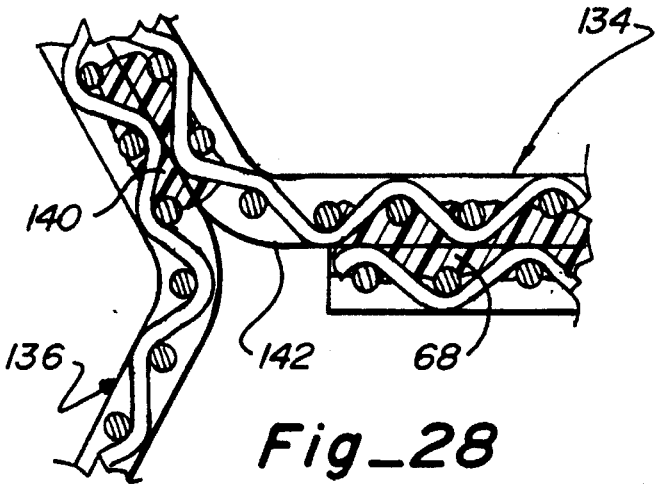
FIG. 28 is an enlarged fragmentary transverse section showing the juncture line between the vanes and the sheet of the arrangement shown in FIG. 27.

FIG. 24 shows a sixth arrangement 119 of the first embodiment of the present invention wherein vanes 120 are again formed from the same fabric material as a fabric sheet 122 and wherein the vanes are formed by gathering a virgin sheet along elongated horizontally spaced sections to form vertical loops 124 extending rearwardly from the fabric sheet. In this arrangement, however, the gathered loops 124 are rigidified with a stiffening compound 68 as in the earlier described arrangements but the layers of the looped vanes 120 are not bonded together but rather maintained in a spaced relationship. In fact, the loops are formed in an oval tubular configuration so as to lend structural rigidity to the vane in addition to the rigidity which is provided by the stiffening compound. This is more readily appreciated by reference to FIG. 25 which shows the spaced rigidified layers of the fabric material at an intermediate location of a vane. The stiffening compound is preferably applied to the virgin sheet along the horizontally spaced sections before the loops are formed but alternatively the loops might be formed before the stiffening compound is applied.

Figure 26:
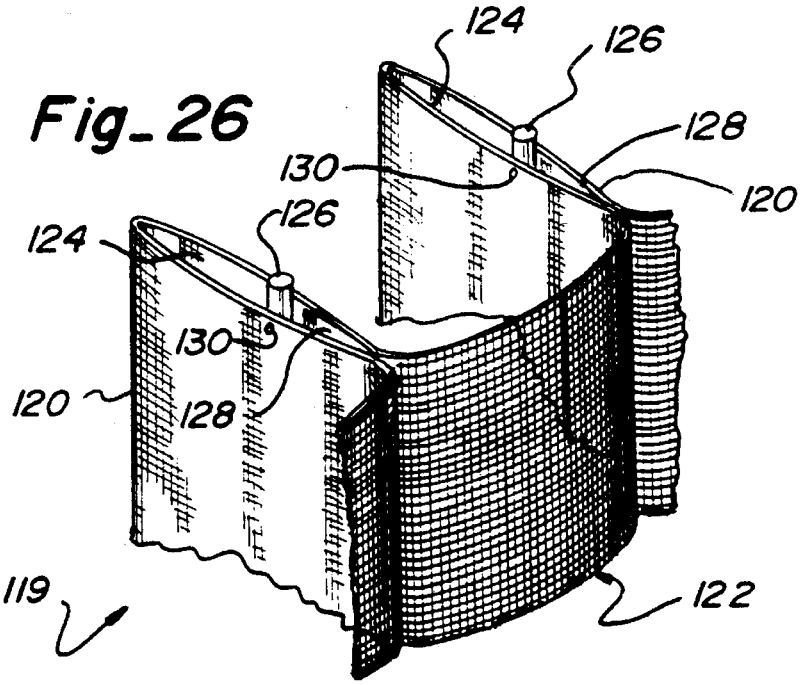
FIG. 26 is a fragmentary isometric view of the arrangement shown in FIGS. 24 and 25.

FIG. 26 is an isometric view showing how the vanes can be interconnected with pivot shafts 126 for suspending the fabric sheet 122 and vanes 120 from a control system (not shown) as described in connection with the first arrangement 54 of the first embodiment of the invention. The pivot shafts 126 are inserted into the upper open ends 128 of the vanes and are pinned to the vanes with transverse pins 130 that extend through both layers of the associated vane as well as the pin itself.

Figure 29:
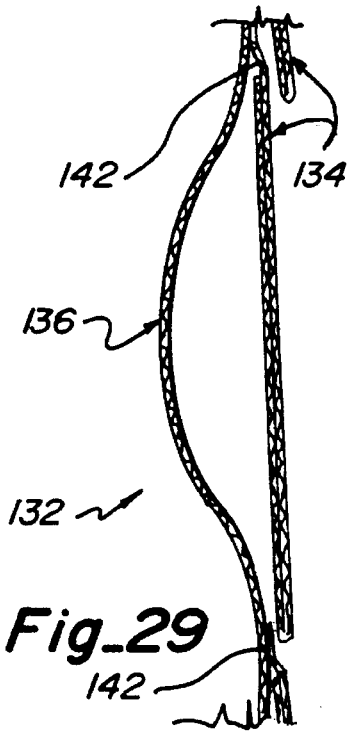
FIG. 29 is a fragmentary transverse section showing the vanes of FIGS. 27 and 28 in a first closed condition.
Figure 27:
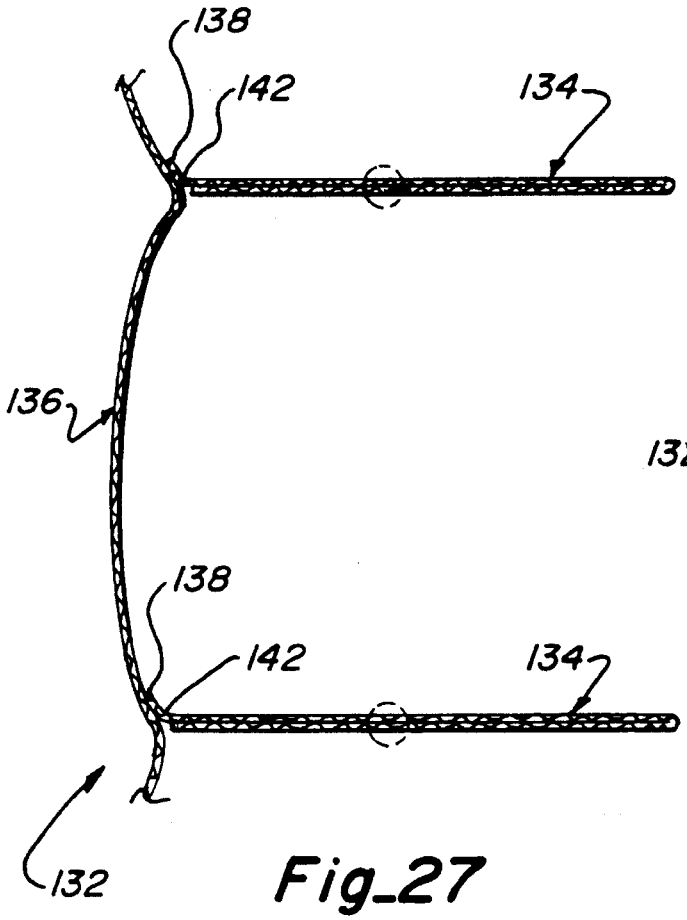
FIG. 27 is a transverse section showing a seventh arrangement of the first embodiment of the present invention with the vanes in an open condition.
Figure 30:
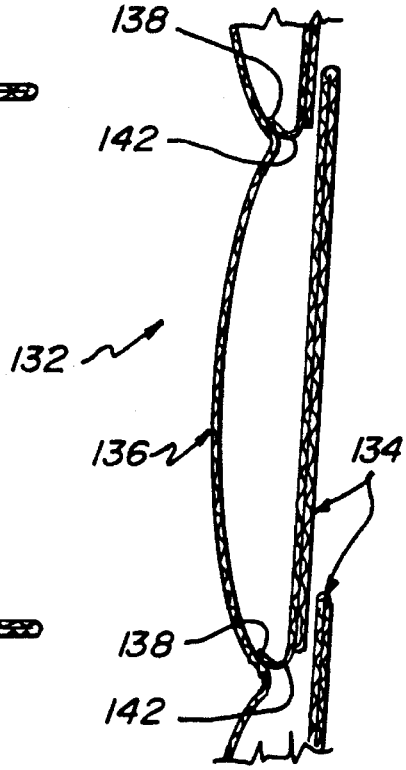
FIG. 30 is a fragmentary transverse section similar to FIG. 29 with the vanes in a reverse or second closed position.

FIGS. 27–30 illustrate a seventh arrangement 132 of the first embodiment of the window covering of the present invention wherein vanes 134 while being formed of the same fabric material as a fabric sheet 136, are independently formed by folding strips of the fabric material back upon themselves so as to define a loop and then integrating the layers together with a stiffening compound 68 while leaving a free edge extension 138 of single layer for attachment to the sheet 136. The strips of fabric from which the vanes are formed may be different from that of the fabric sheet 136 but preferably for aesthetic purposes the fabrics are the same. The extension 138 is bonded to the sheet with any suitable adhesive 140 such as a hot melt adhesive manufactured and sold by EMS-American Grilon, Inc. of Charlotte, N.C. under the brand name Grilltex. This provides a single layer hinge along the juncture line 142 between the vanes and the sheet for desired flexibility. FIGS. 27, 29 and 30 respectively show this arrangement of the invention in an open condition, a first closed condition and a second closed condition wherein the vanes are pivoted 180 degrees from the first closed position.

Figure 32:
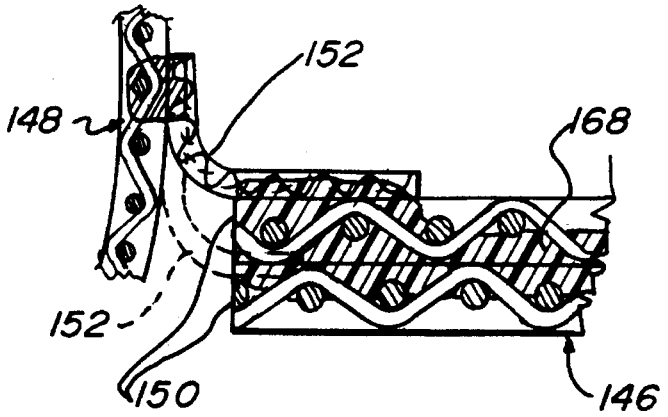
FIG. 32 is an enlarged fragmentary transverse section showing the juncture line between the vanes and the attached sheet of the arrangement shown in FIG. 31.
Figure 31:
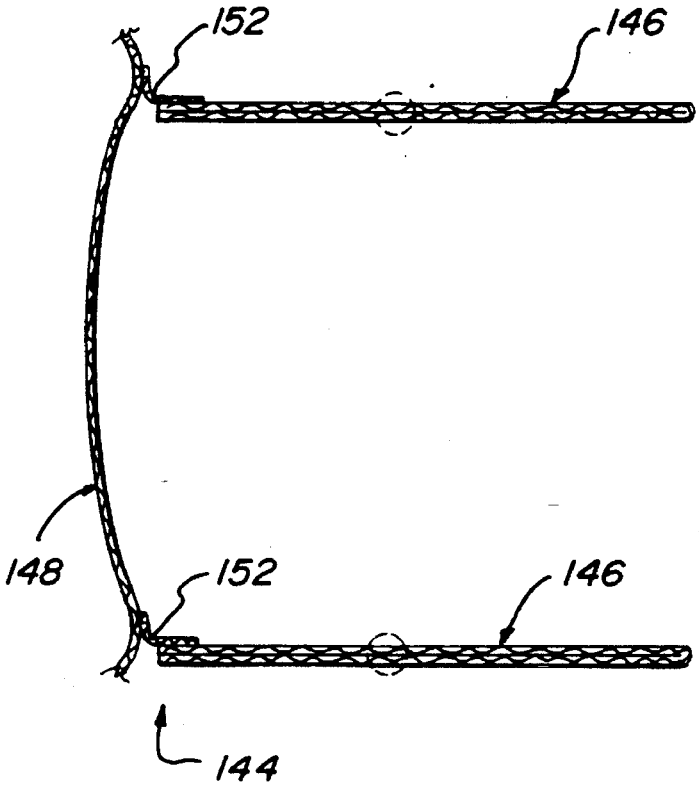
FIG. 31 is a fragmentary transverse section of an eighth arrangement of the first embodiment of the present invention with the vanes in an open position.
Figure 33:
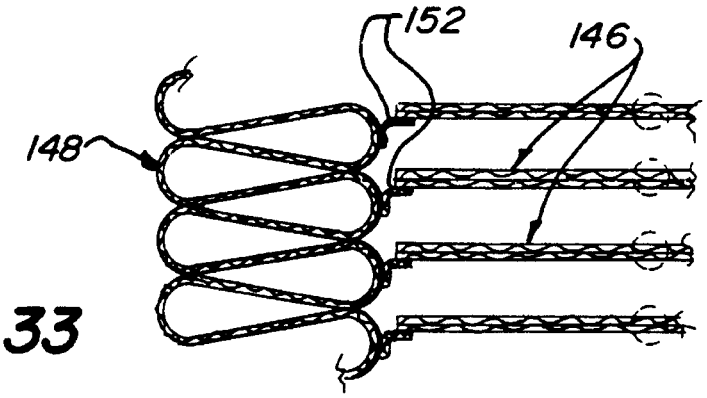
FIG. 33 is a fragmentary transverse section similar to FIG. 31 with the vanes shifted into a closely adjacent side by side relationship.

In an eighth arrangement 144 of the first embodiment of the present invention illustrated in FIGS. 31–33, fabric vanes 146 are again formed independently from a sheet 148 by forming a loop of fabric which has been folded back upon itself and bonded together with a stiffening compound 68 but wherein edges 150 of the strips of fabric from which the vanes are formed are aligned. The vanes are then connected to the fabric sheet 148 along one edge with a flexible ribbon type connector 152 of a material that is preferably as flexible or more flexible than the material from which the vanes are made. The interconnection of the vanes 146 to the fabric sheet by the ribbon like connector 152 is best seen in FIG. 32 wherein the same face of the ribbon type connector is bonded to both the sheet 148 and one surface of the vane 146 with a bonding medium such as the previously mentioned hot-melt adhesive. It will be appreciated that the connector 152 could be connected to the vane in other ways such as by inserting the ribbon type connector 152 between the layers of the vane as shown in dashed lines.

FIGS. 31 and 33 show the eighth arrangement of the window covering in section. In FIG. 31 the vanes 146 are spaced to an optimum whereas in FIG. 33 the vanes are in closely spaced relationship as when the window covering is shifted by the carriers to one side of a window opening (not shown) in which the window covering is mounted.

Figure 34:
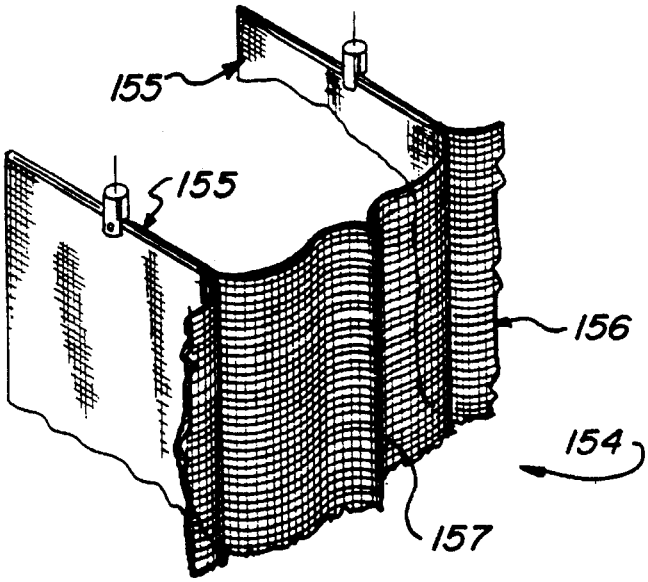
FIG. 34 is a fragmentary isometric view of a ninth arrangement of the first embodiment of the present invention with the vanes being formed in accordance with the arrangement illustrated in FIGS. 1–11 but with the sheet being pleated between vanes.
Figure 36:
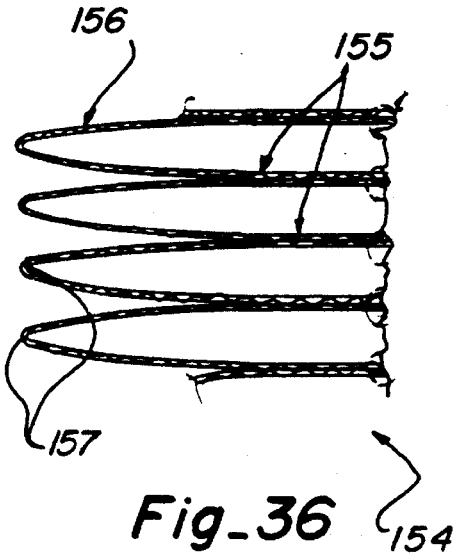
FIG. 36 is a fragmentary transverse section of the embodiment shown in FIG. 34 with the vanes being open and moved into closely adjacent side by side relationship.

FIG. 34 shows a ninth arrangement 154 of the first embodiment of the window covering of the present invention wherein vanes 155 have been formed identically to the first arrangement 54 of FIGS. 1–11 but wherein a fabric sheet 156 is creased at 157 in parallel with the vanes at intermediate locations between each vane for a varied aesthetic appearance. This arrangement is shown in FIG. 36 in section showing how the window covering would look when the vanes are open but shifted to one side in closely adjacent relationship.

Figure 35:
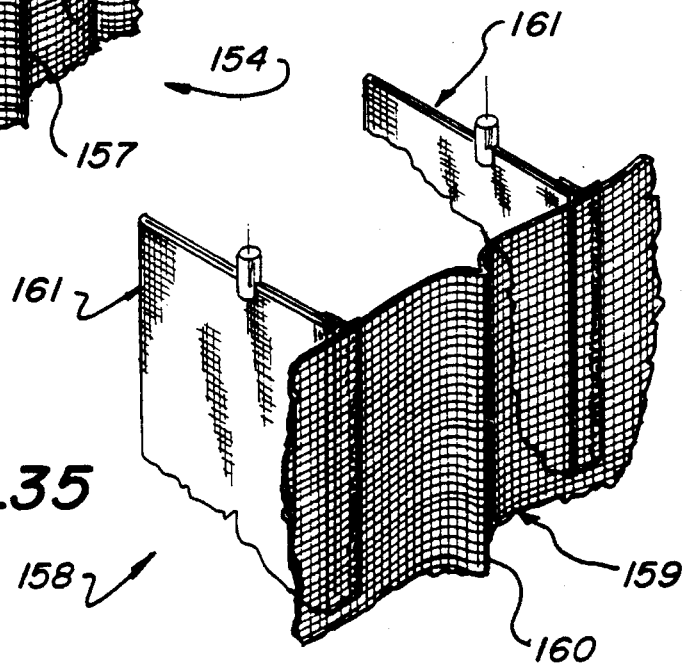
FIG. 35 is a fragmentary isometric view of a tenth arrangement of the first embodiment of the present invention with the vanes in an open condition and being connected to the sheet in accordance with the embodiment shown in FIGS. 31–33 but with the sheet being pleated between vanes.
Figure 37:
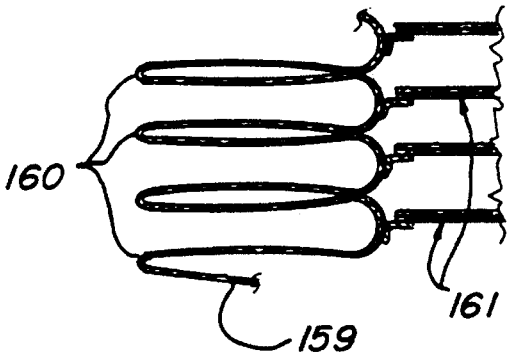
FIG. 37 is a fragmentary horizontal section of the embodiment shown in FIG. 35 with the vanes being opened and shifted into a closely adjacent side by side relationship.

FIG. 35 shows a tenth arrangement 158 of the first embodiment of the window covering of the present invention with this embodiment being similar to the eighth arrangement 144 shown in FIGS. 31–33 but wherein a fabric sheet 159 has been creased along lines 160 parallel with vanes 161 at intermediate locations between the vanes. FIG. 37 shows how the window covering of FIG. 35 would look with the vanes in an open condition but shifted to one side of the window in which it is mounted in closely adjacent relationship.

FIGS. 53 and 54 show an eleventh arrangement 162 of the first embodiment of the window covering of the present invention with this arrangement having a pair of substantially parallel transparent or translucent fabric sheets **164*a* and 164*b* and vanes 166 extending therebetween. The vanes are formed by gathering a virgin sheet, corresponding to the fabric sheets 164*a*, at spaced parallel locations to form loops 167 of the fabric material. Each loop has two layers of fabric and the layers are bonded together along a juncture line 168** where the loops are continuous with the fabric sheet 164*a*. The loops thereby define pockets into which relatively rigid elongated slats 170 of aluminum, plastic or the like are inserted to rigidify the vane. The loops 167 of fabric in combination with the slats 170 constitute the vanes 166. The fabric along the free edge 171 of each vane 166 so formed is connected to the other fabric sheet 164*b* as by bonding with a suitable adhesive or the like so that the vanes interconnect the two fabric sheets and retain a substantially uniform spacing therebetween. The vanes can be oriented vertically or horizontally and, in the case of a vertical orientation, controlled with an appropriate control mechanism of the type described previously in this application. In the case of a horizontal orientation, a control mechanism of the type disclosed in pending U.S. application Ser. No. 07/717,284 U.S. Pat. No. 5,320,154 filed Jun. 20, 1991 could be used, which application is hereby incorporated by reference.

FIGS. 55 and 56 show a twelfth arrangement 172 of the first embodiment of the present invention where again a pair of transparent or translucent fabric sheets 174*a* and 174*b* are interconnected in substantially parallel spaced relationship by a plurality of parallel vanes 176. The vanes are formed in the same manner as the vanes in the embodiment shown in FIGS. 53 and 54 but the vanes are formed by gathering loops 178 of fabric off each fabric sheet rather than forming all of the looped vanes from one of the fabric sheets. The looped vanes 176 formed off each fabric sheet alternate so that adjacent vanes are formed off opposite sheets 174*a* and 174*b*. Again, the vanes are formed from the relatively soft fabric material of the fabric sheets and rigidified with an elongated relatively rigid slat 180 of aluminum, plastic or the like. The fabric along the free edge 181 of each vane is secured to the fabric sheet from which it is not formed as by bonding with a suitable adhesive. Again, the vanes can be oriented vertically or horizontally and the window covering would be operated with an appropriate control mechanism of the type described previously in this application.

Figure 57:
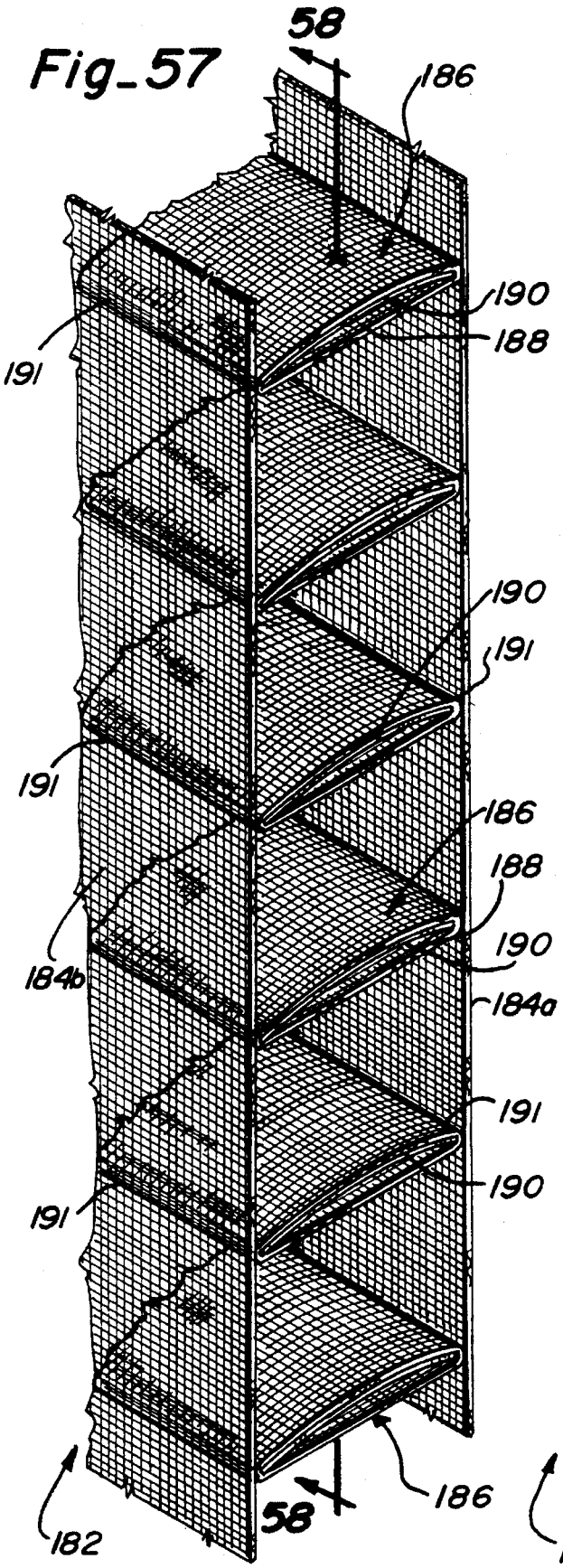
FIG. 57 is a fragmentary isometric of a thirteenth arrangement of the first embodiment of the present invention with the vanes in an open position.
Figure 58:
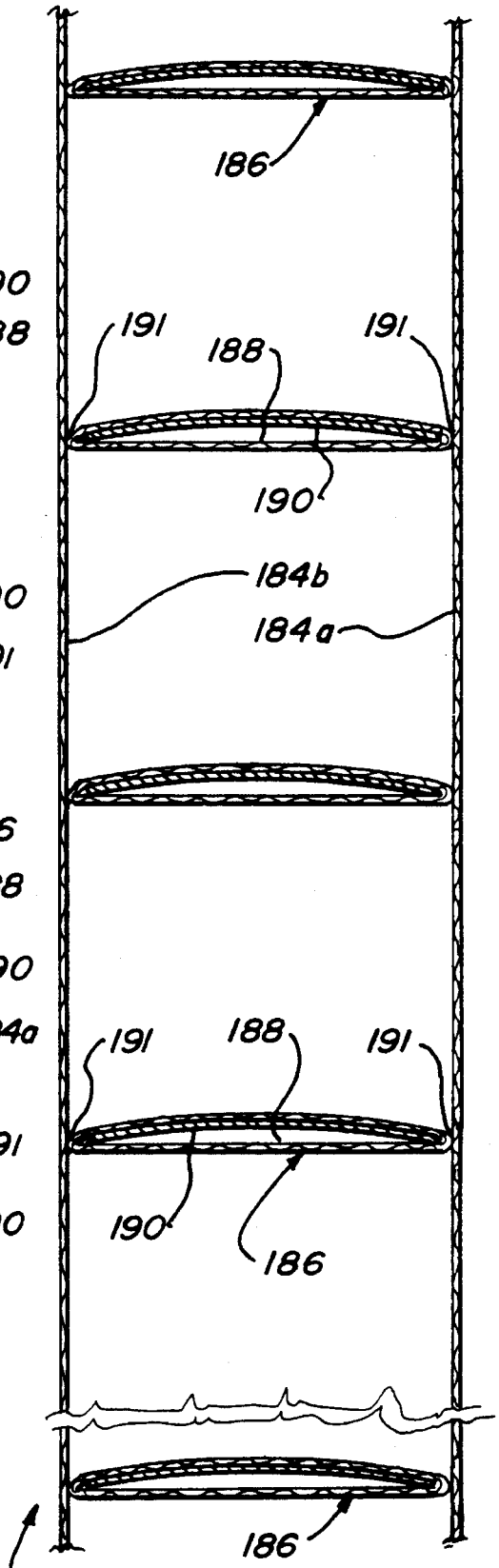
FIG. 58 is an enlarged section taken along line 58—58 of FIG. 57.

FIGS. 57 and 58 show a thirteenth arrangement 182 of the first embodiment of the window covering of the present invention which again includes a pair of spaced transparent or translucent fabric sheets 184*a* and 184*b* interconnected in substantially parallel relationship by a plurality of parallel vanes 186. The vanes in this arrangement are made by forming an independent loop 188 of fabric material such as of the type used for the fabric sheets, with the loop being closed. The loop lee might simply be formed by folding a strip of such material back upon itself and adhesively bonding the free edges. A pocket is defined by the loop and an elongated relatively rigid slat 190 of aluminum, plastic or the like is inserted into the pocket. Opposite edges 191 of the vanes so formed are secured to the internal faces of the opposing fabric sheets 184*a* and 184*b* as by bonding with a suitable adhesive. Again, the vanes could be oriented vertically or horizontally and the window covering operated with an appropriate control mechanism of the type disclosed previously in this application.

Figure 59:
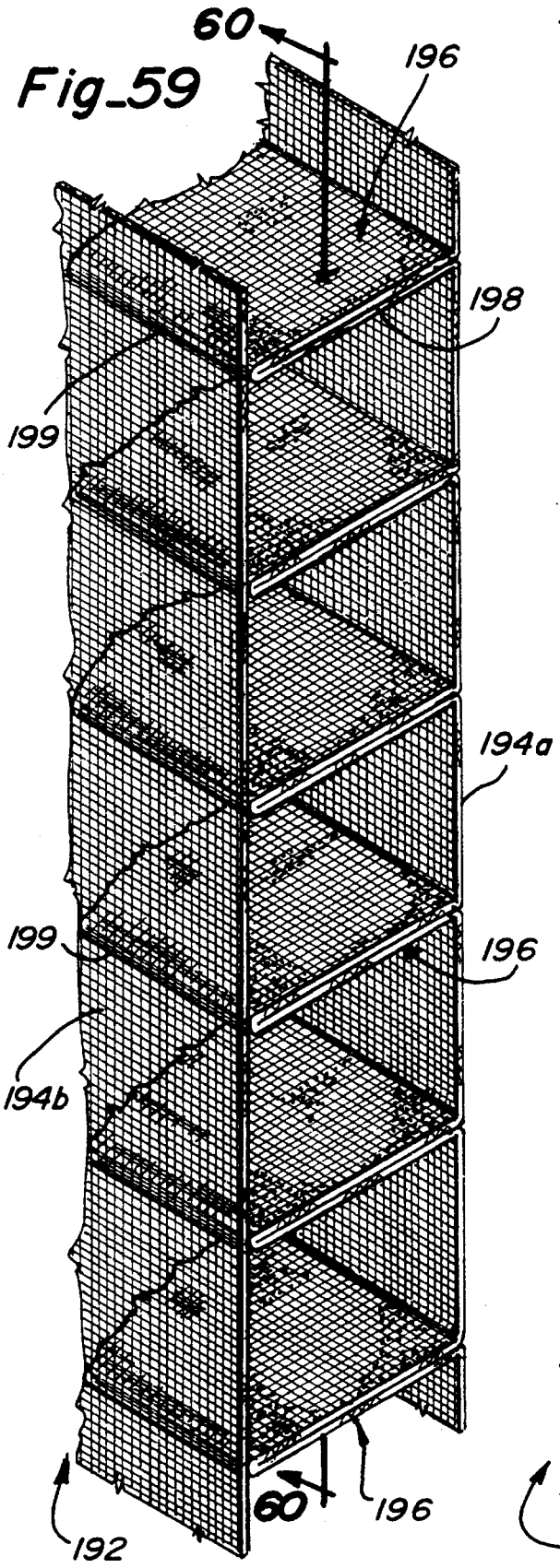
FIG. 59 is a fragmentary isometric of a fourteenth arrangement of the first embodiment of the present invention with the vanes in an open position.
Figure 60:
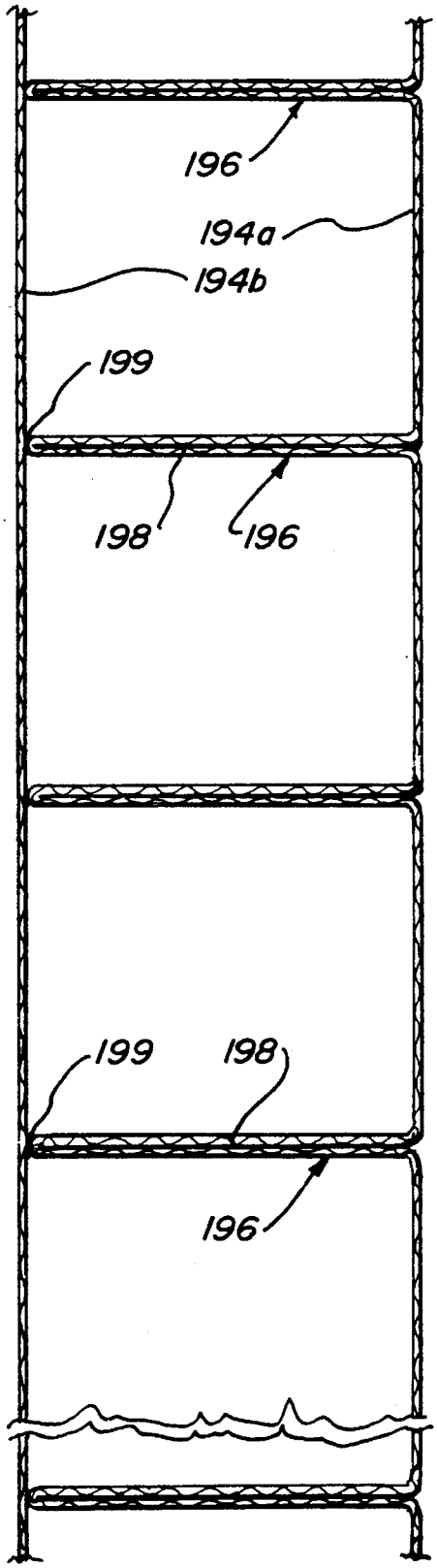
FIG. 60 is an enlarged fragmentary section taken along line 60—60 of FIG. 59.

FIGS. 59 and 60 illustrate a fourteenth arrangement 192 of the first embodiment of the window covering of the present invention wherein the window covering again has a pair of substantially parallel translucent or transparent fabric sheets 194*a* and 194*b* interconnected by parallel vanes 196. In this arrangement, the vanes are formed by gathering strips of fabric off one face of a virgin sheet corresponding with the fabric sheet 194*a* so as to form parallel loops 198 of the fabric having two layers. The layers are then bonded together in a manner described previously in connection with the arrangement shown in FIGS. 1–11. The free edge 199 of each vane so formed is secured to the other fabric sheet 194*b* as with a suitable adhesive. Again, the vanes could be oriented horizontally or vertically and the window covering operated with an appropriate control mechanism of the type previously described in this application.

Figure 61:
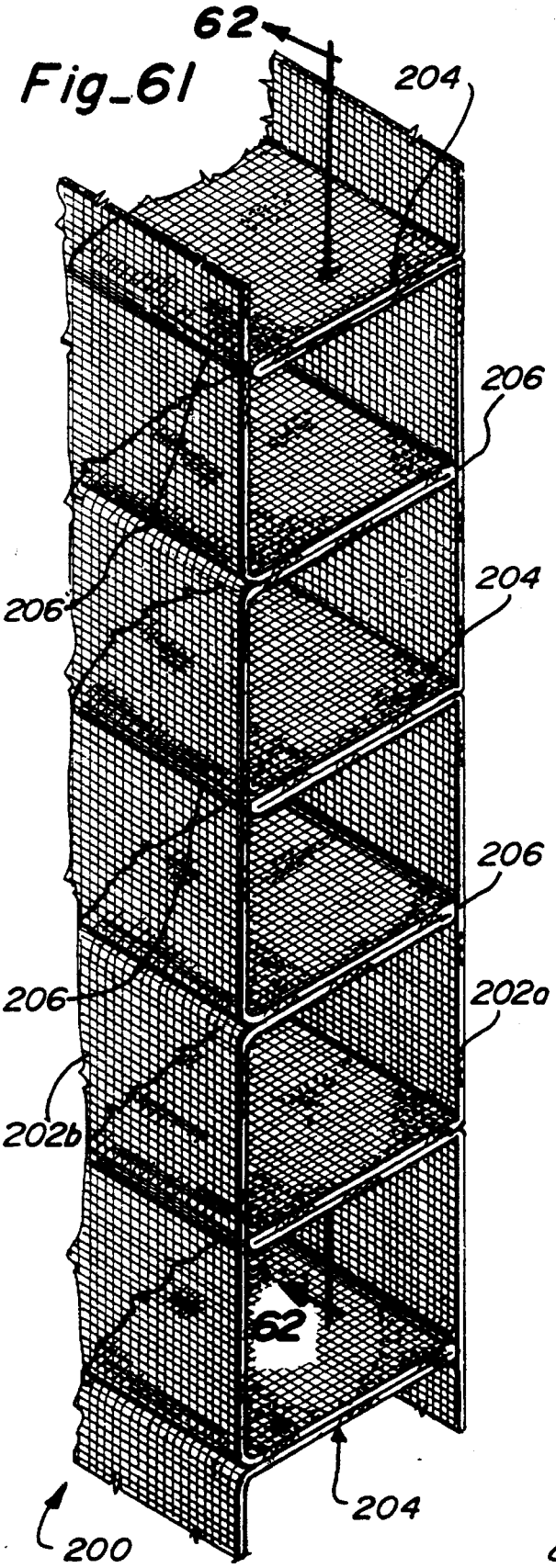
FIG. 61 is a fragmentary isometric of a fifteenth arrangement of the first embodiment of the present invention with the vanes in an open position.
Figure 62:
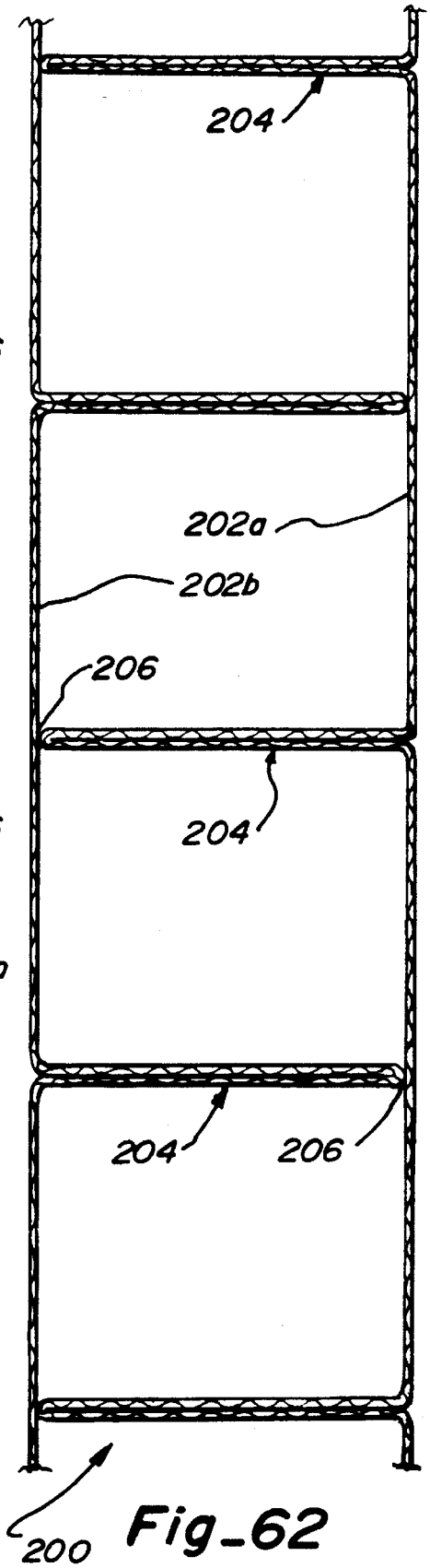
FIG. 62 is an enlarged fragmentary section taken along line 62—62 of FIG. 61.

FIGS. 61 and 62 show a fifteenth arrangement 200 of the first embodiment of the window covering of the present invention wherein again a pair of transparent or translucent fabric sheets 202*a* and 202*b* are retained in substantially parallel relationship by a plurality of parallel vanes 204. In this arrangement, the vanes are formed in the same manner as the arrangement illustrated in FIGS. 59 and 60 except the vanes are formed alternately from each fabric sheet 202*a* and 202*b* such that adjacent vanes 204 are formed from opposite fabric sheets. As with the arrangement shown in FIGS. 59 and 60, the free edge 206 of each vane is secured to the fabric sheet 202*a* or 202*b* with a suitable adhesive. Again, the vanes could be oriented vertically or horizontally and the window covering would be operated with a control mechanism of the type previously described in this application.

Figure 63:
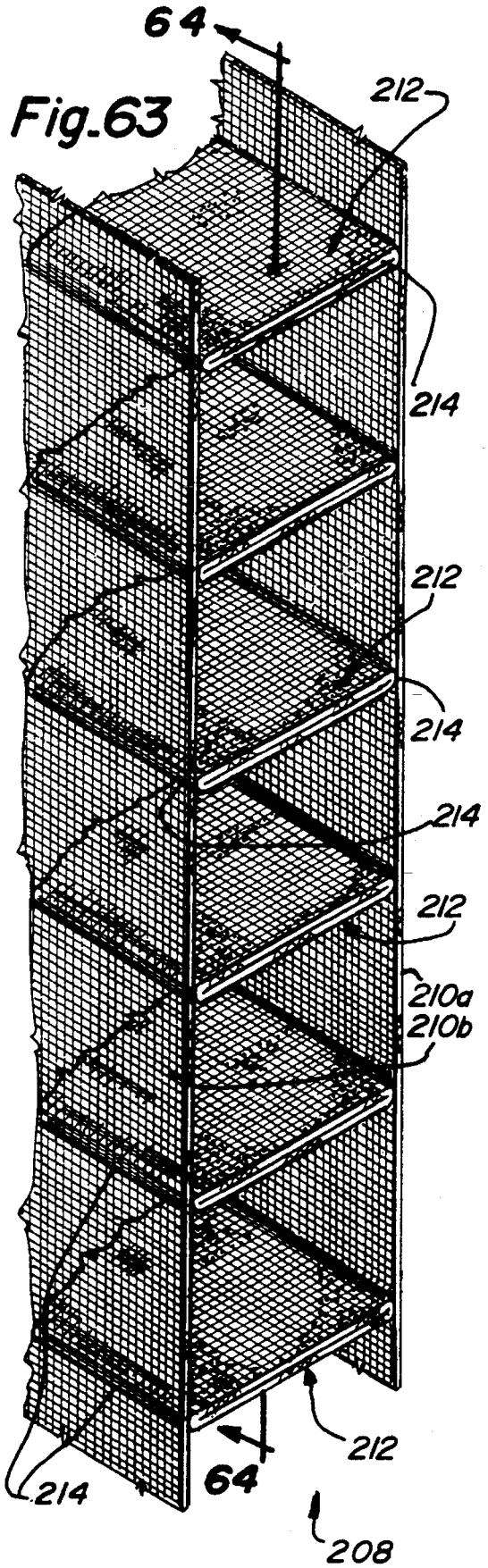
FIG. 63 is a fragmentary isometric showing a sixteenth arrangement of the first embodiment of the present invention.
Figure 64:
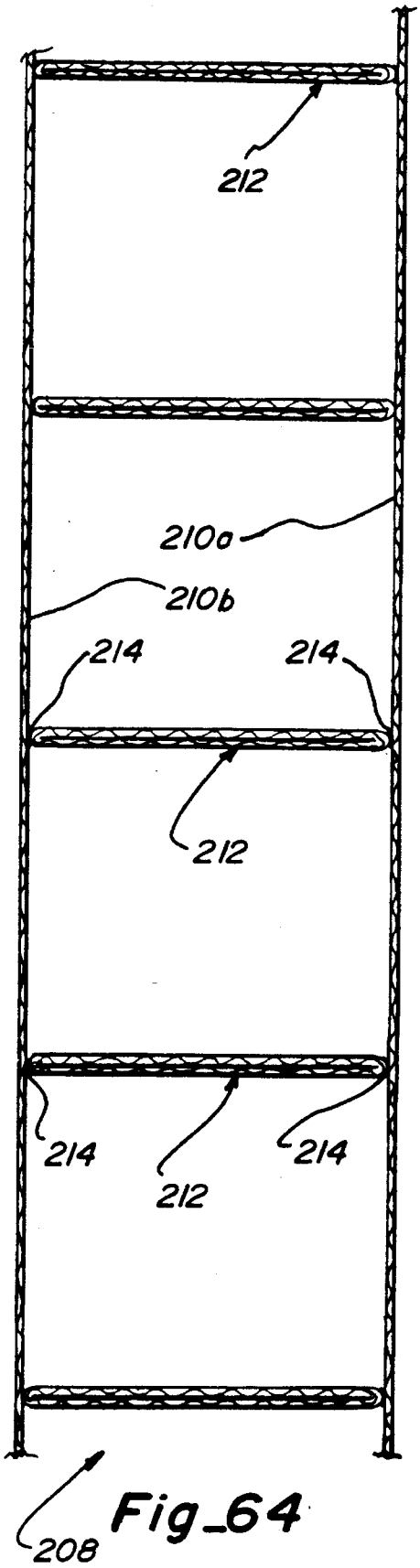
FIG. 64 is an enlarged fragmentary section taken along line 64—64 of FIG. 63.

FIGS. 63 and 64 show a sixteenth arrangement 208 of the first embodiment of the window covering of the present invention wherein the window covering includes a pair of substantially parallel transparent or translucent fabric sheets 210*a* and 210*b* secured together by a plurality of parallel vanes 212. In this arrangement, the vanes are made by forming independent loops of a fabric material utilizing, for example, the fabric from which the fabric sheets are made. The loops may be formed by folding strips of the material back upon themselves and bonding each layer of the loop together with a stiffening compound so that the vanes maintain a fixed substantially planar configuration. The opposite edges 214 of the vanes so formed are then secured to internal faces of the opposing fabric sheets 210*a* and 210*b* as by bonding with a suitable adhesive. Again, the vanes could be oriented vertically or horizontally and the window covering would be operated with an appropriate control mechanism of the type previously described in this application.

Figure 6B:
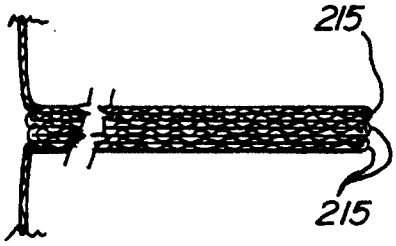
FIG. 6B is a view similar to FIG. 6A showing a multiple fold variation of the window covering.

It will be appreciated that with any of the afore-described arrangements of the first embodiment of the present invention the vanes could have more than two layers of fabric by forming multiple closely adjacent or contiguous folds 215. An illustrative example of such an arrangement forming a variation off the arrangement of FIG. 1–11 is shown in FIG. 6B.

FIGS. 38–48 show a first arrangement 216 of a second embodiment of the present invention wherein a fabric sheet 218 of material is integrally connected with vanes 220 protruding off a rear face 222 of the sheet 218 and with the sheet and vanes being supported in a head rail 224 by a control system 226 of the type conventionally used with venetian blinds. As probably most clearly illustrated in FIGS. 45–48, the vanes 220 are formed at vertically spaced locations along the sheet 218 by gathering a virgin sheet so as to form the fabric sheet 218 and rearwardly projecting and horizontally extending loops defining pockets 228 into which slats 230 of aluminum, plastic or the like are inserted. The two layers of each pocket are bonded together along a horizontal juncture line 232 adjacent to the sheet to form a living hinge thereby allowing the vanes to pivot relative to the sheet. The slats 230 provide the rigidity desired for operation of the window covering.

Figure 42:
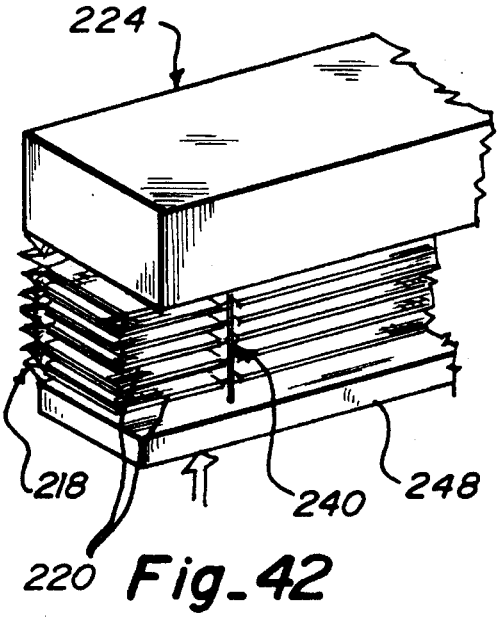
FIG. 42 is a fragmentary isometric showing the vanes in a stacked relationship adjacent a head rail for the window covering.
Figure 41:
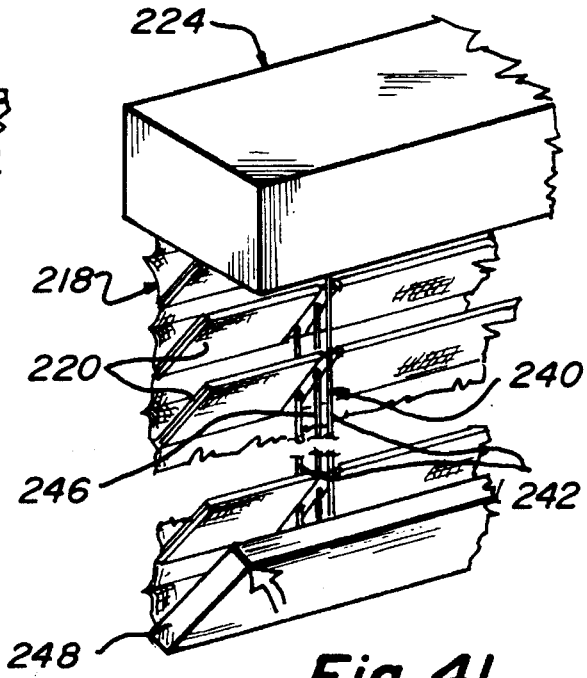
FIG. 41 is a fragmentary isometric similar to FIG. 40 showing the front side of the window covering with the vanes in a partially closed position.
Figure 43:
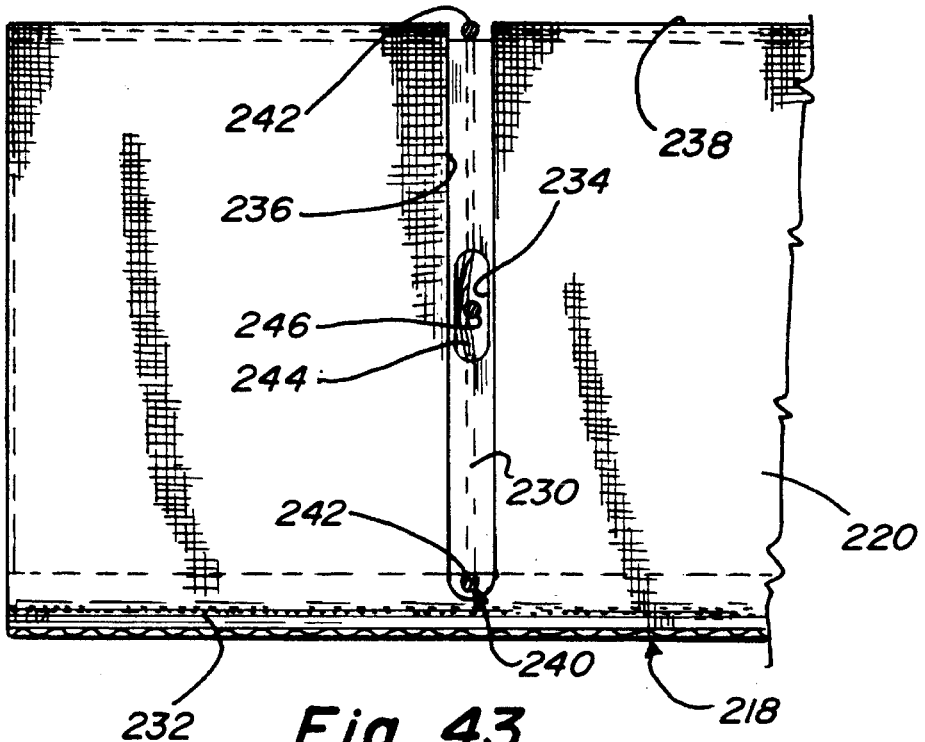
FIG. 43 is an enlarged fragmentary section taken along line 43—43 of FIG. 38.
Figure 44:
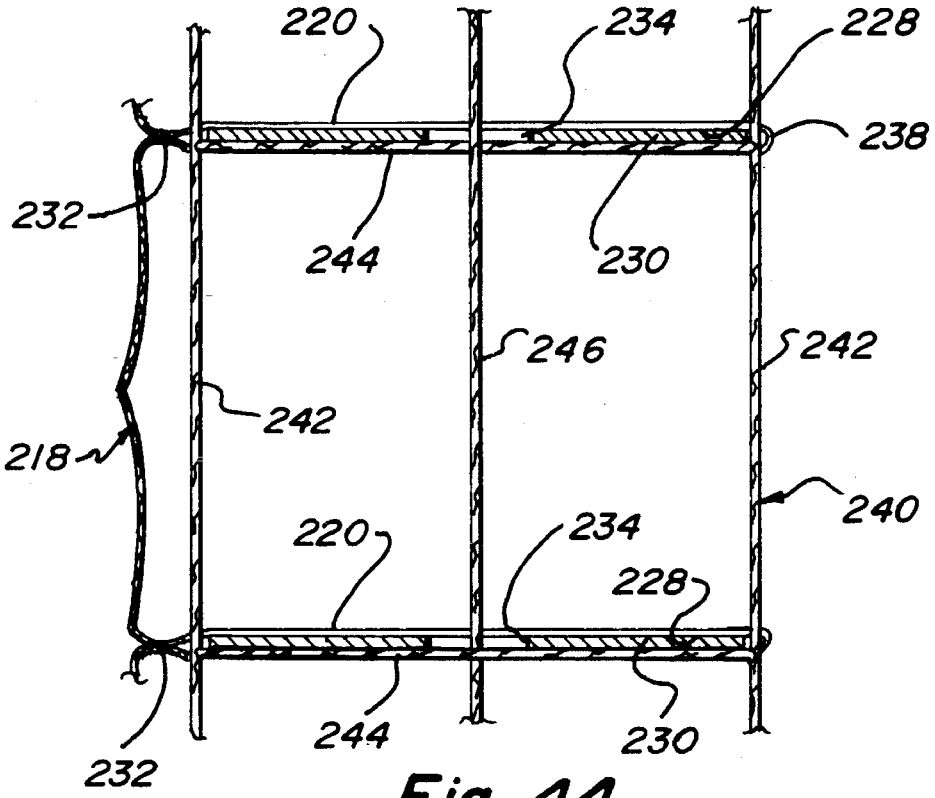
FIG. 44 is an enlarged fragmentary section taken along line 44—44 of FIG. 38.
Figure 45:
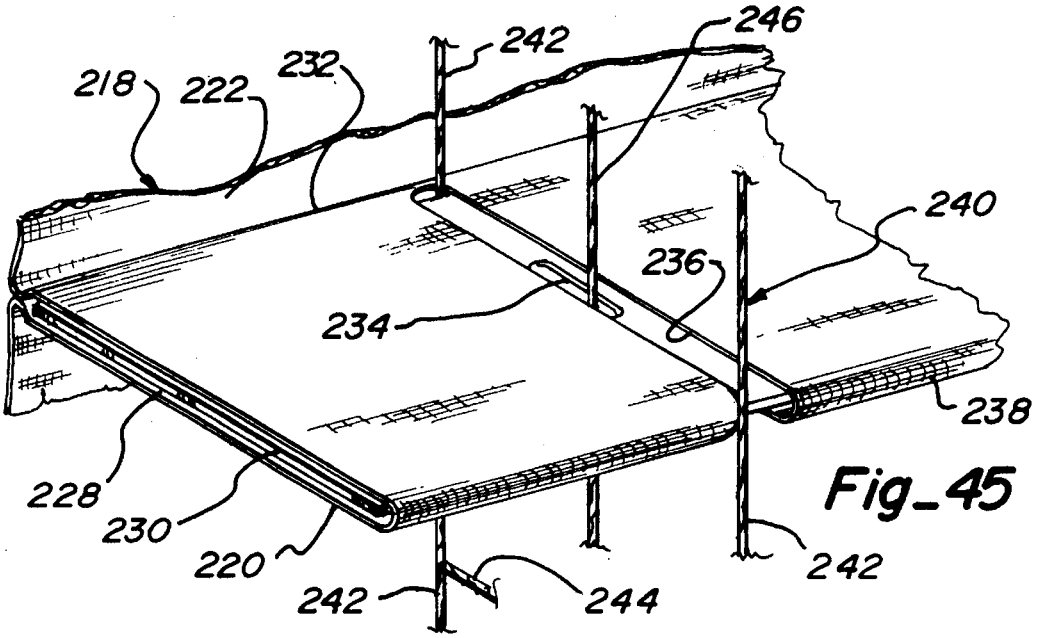
FIG. 45 is an enlarged fragmentary isometric view showing one vane of the embodiment illustrated in FIG. 38 in an open condition.
Figure 46:
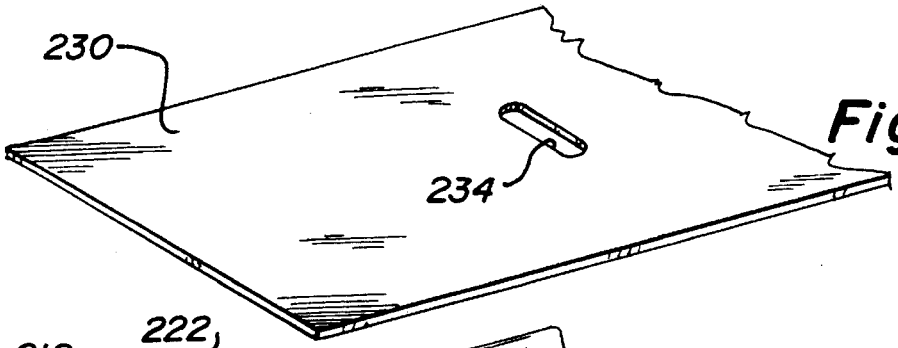
FIG. 46 is a fragmentary isometric view of a rigid slat utilized in the vanes of the embodiment shown in FIG. 38.
Figure 47:
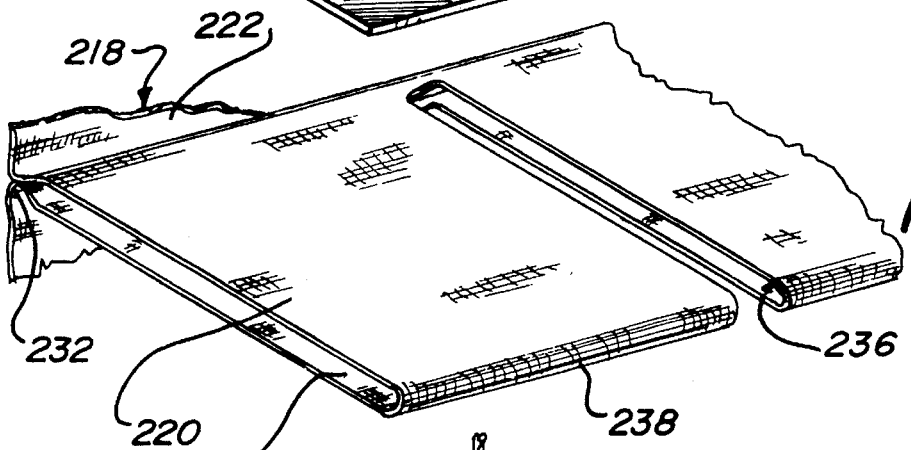
FIG. 47 is a fragmentary isometric showing the looped fabric adapted to receive the slat of FIG. 46.
Figure 48:
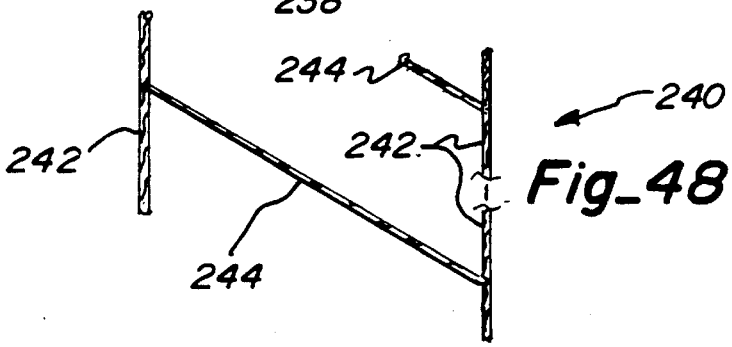
FIG. 48 is a fragmentary isometric view of a tape ladder used in operating the vanes of the window covering shown in FIG. 38.

At longitudinally spaced locations along the length of each slat 230, a transverse slot 234 is cut through the slat and this slot is aligned with a larger slot 236 cut into the fabric pocket 228 from the rear edge 238 of the pocket to a location closely adjacent to the juncture line 232. Slots 234 and 236 are provided at each location where a vertically extending tape ladder 240, as conventionally used in venetian blinds, is to be located. The tape ladders 240 consist of a pair of longitudinal or vertically extending stringers 242 that are interconnected at vertically spaced locations by cross rungs 244 and the cross rungs are disposed beneath each vane 220. The stringers are disposed along opposite side edges of each slat in alignment with the slot 234 in the slat and a vertical lift cord 246 is interwoven through the rungs of the tape ladder in a conventional manner to lift the slats from a vertically spaced orientation, as shown for example in FIGS. 38 and 40 to a stacked relationship adjacent the head rail 224 as illustrated in FIG. 42. The lift cord is interwoven through the cross rungs 244 in a manner known in the industry and as clearly illustrated in co-pending application Ser. No. 08/028,791, U.S. Pat. No. 5,349,730, filed Mar. 9, 1993 which is of common ownership with the present application and the disclosure therein is hereby incorporated by reference.

Figure 38:
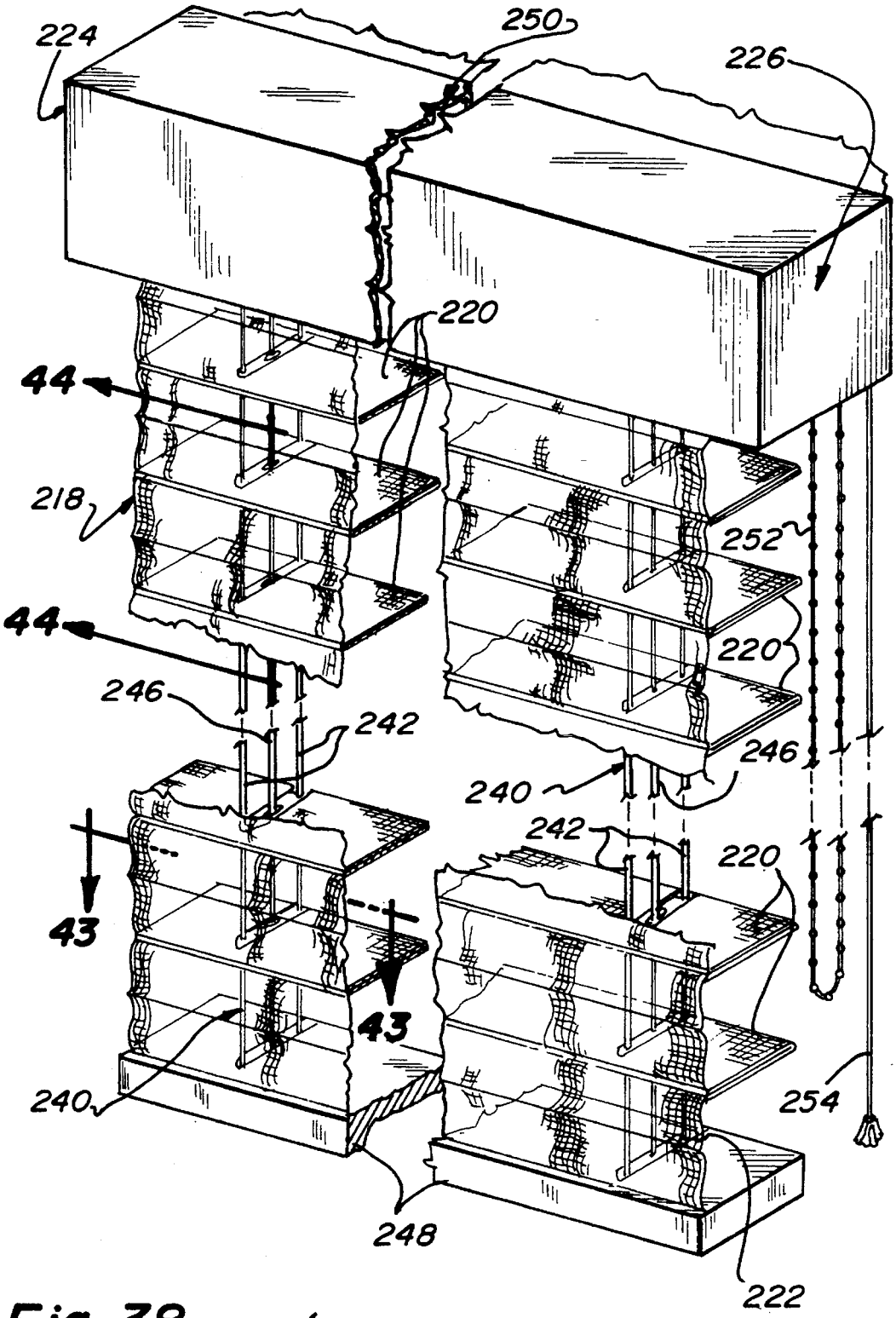
FIG. 38 is a fragmentary isometric view of a second embodiment of the present invention.

A bottom rail 248 which is relatively heavy in comparison to the slats 230 is suspended beneath the lowermost vane 220 and is conventionally interconnected with the tape ladder and the lift cord. Manipulation of the tape ladder and lift cord by a conventional control system 250 that is only partially illustrated moves the vanes between open and closed angular positions where they are substantially perpendicular to or parallel with the fabric sheet 218 respectively and spaced or stacked positions as mentioned above. With reference to FIG. 38, a continuous beaded cord 252 is provided to reciprocally shift the stringers 242 of the tape ladders in vertical directions so that the vanes are tilted in one direction or the other while a pull cord 254 is operatively attached to the lift cord 246 and can be manually manipulated to raise the vanes from the spaced position of FIG. 39 to the stacked position of FIG. 42. Of course, conventional brake systems (not shown) are provided within the control system to retain the vanes in the stacked relationship of FIG. 42 when desired.

Figure 39:
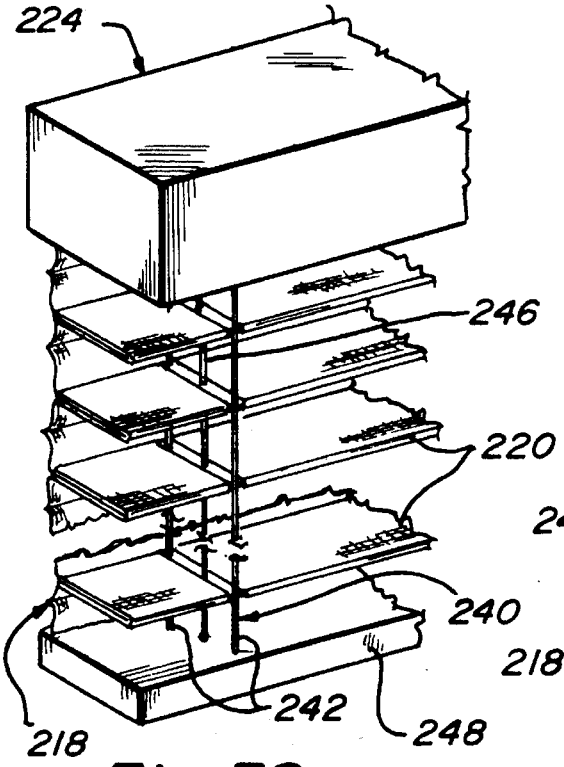
FIG. 39 is a fragmentary isometric similar to FIG. 38 but showing the opposite side of the window covering.
Figure 40:
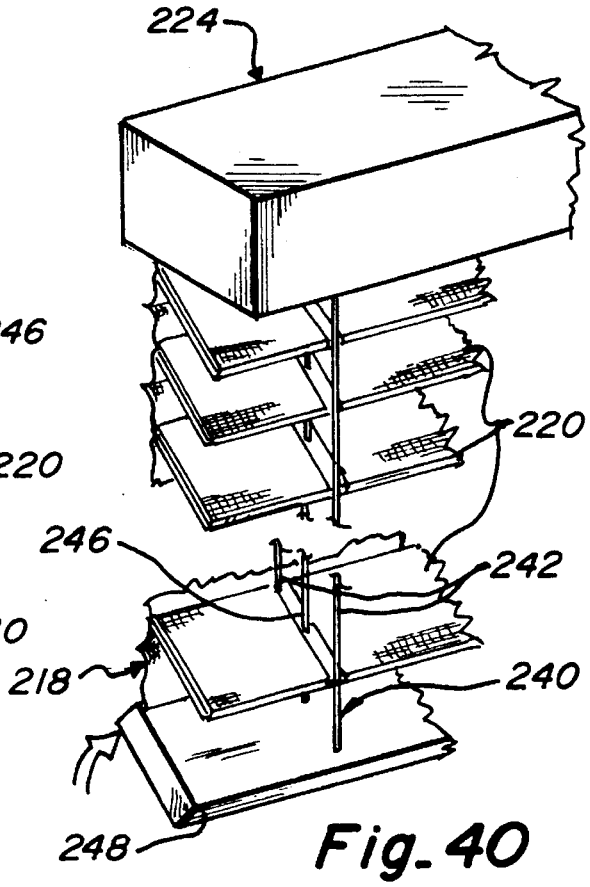
FIG. 40 is a fragmentary isometric of the second embodiment showing the vanes from a rear side in a partially closed position.

The fabric sheet 218 is preferably made of a transparent or translucent material such as sheer while the vanes 220 are preferably opaque through the use of aluminum, plastic or other suitable slat material which prevents the passage of light and vision through the window covering when the vanes are in a closed position. Of course, when the vanes are extended substantially perpendicularly to the sheet in the open condition as shown in FIGS. 38 and 39, both light and vision are permitted through the window covering.

While the fabric sheet 218 has been illustrated as being horizontally pleated at intermediate locations between vanes, the pleats may be removed for varied aesthetics.

Figure 49:
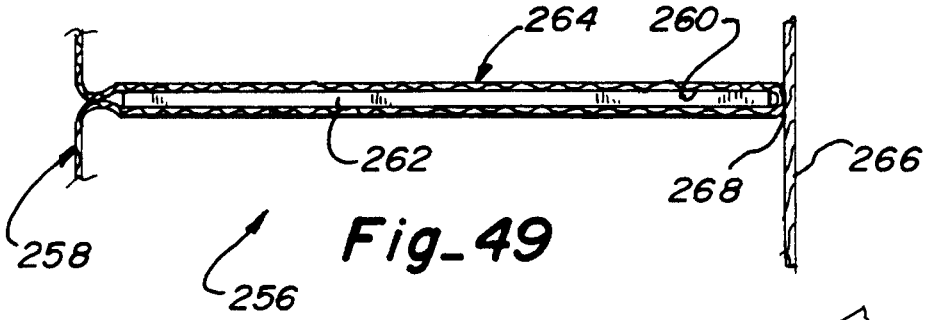
FIG. 49 is a fragmentary transverse section taken through a vane in a second arrangement of the second embodiment of the present invention wherein support cords are fixed to a rear edge of the vanes.
Figure 50:
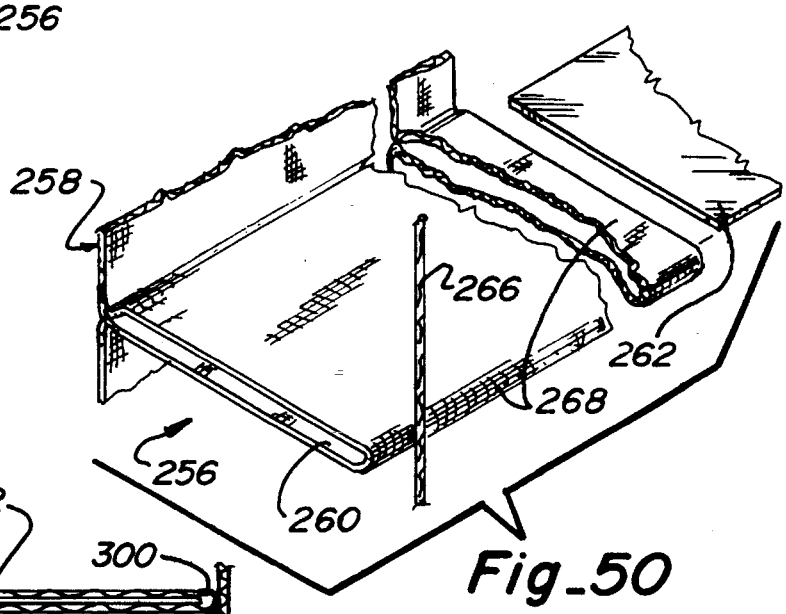
FIG. 50 is a fragmentary isometric view of the arrangement shown in FIG. 49 with a rigid slat being removed from the looped fabric pocket for the slat.

FIGS. 49 and 50 show a second arrangement 256 of the second embodiment of the present invention where again a virgin sheet of fabric material is gathered to form a sheet 258 and fabric loop type pockets 260 for relatively rigid slats 262 but wherein the vanes 264 are not supported with tape ladders as in the first described arrangement 216 of the second embodiment but rather are supported at a rear edge by spaced vertically extending support cords 266. The cords 266 are secured to the rear edge 268 of each vane at horizontally spaced locations in any suitable manner. Suitable examples for attaching cords of this type to the rear edge of the vanes are illustrated in U.S. Pat. No. 4,928,369 and Australian Patent No. 249,985 which are herein incorporated by reference.

The control system (not shown) for the embodiment shown in FIGS. 49 and 50 would include means for vertically shifting the support cords 266 reciprocally relative to the sheet 258. Such movement of the cords tilts the vanes as desired between an open position wherein they extend substantially perpendicularly to the fabric sheet and a closed position wherein they extend substantially parallel to the fabric sheet. Means may also be provided in the control system for lifting the entire window covering into a head rail (not shown) by rolling the sheet and vanes about a roller. Control systems suitable for this purpose are known in this art.

A third arrangement 270 of the second embodiment of the present invention is illustrated in FIG. 51 wherein a virgin sheet is again gathered at spaced locations to form a fabric sheet 272 and looped fabric pockets 274 having relatively rigid slats 276 inserted therein but wherein a second sheet 278 is bonded or otherwise affixed to a rear edge 280 of the vanes with any suitable adhesive. The sheets 272 and 278 may be suspended by a control system (now shown) that allows the sheets to be vertically and reciprocally moved relative to each other to shift the vanes between open and closed positions and may also include a roller around which the sheets and the vanes can be wrapped to lift the window covering vertically out of the window opening in which it is mounted. A suitable control system may be of the type described in the aforenoted U.S. patent application Ser. No. 07/717,284 filed Jun. 20, 1991.

Preferably, the sheets 272 and 278 would be made of transparent or translucent material such as sheer while the vanes again would be opaque due to the preferably opaque nature of the slats utilized therein.

Figure 52:
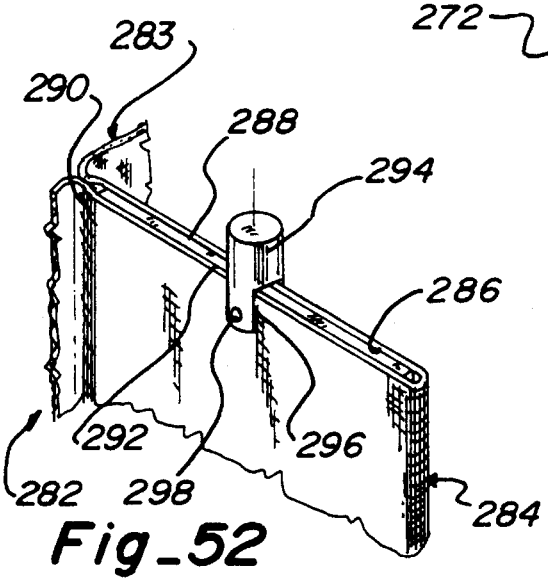
FIG. 52 is a fragmentary isometric view of a fourth arrangement of the second embodiment of the present invention with the slats arranged in a vertical orientation.

FIG. 52 illustrates a fourth arrangement 282 of the second embodiment of the present invention wherein the window covering includes a fabric sheet 283 and vanes 284 which are oriented vertically but again formed by gathering material from the virgin sheet corresponding to the fabric sheet 283, and looping the material in order to define a fabric pocket 286 in which a rigid slat 288 is inserted. The two layers of each vane are bonded together along a juncture line 290 adjacent to the fabric sheet 283. The vanes are supported at a top edge 292 by a shaft 294 which may be notched at 296 to receive the top edge of a vane and secured thereto with a pin 298 so that the shaft can be conventionally supported by a carrier (not shown) of the type disclosed more fully in the aforementioned U.S. Pat. No. 4,724,883. These carriers, as mentioned previously, are operative to either pivot the vanes between open and closed positions wherein they lie substantially perpendicularly or in parallel relationship with the fabric sheet respectfully and can also be shifted to one side of the window in which the window covering is mounted.

Figure 51B:
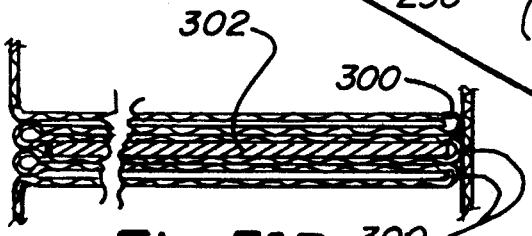
FIG. 51B is a view similar to FIG. 51A showing a multiple fold variation of the window covering.
Figure 51A:
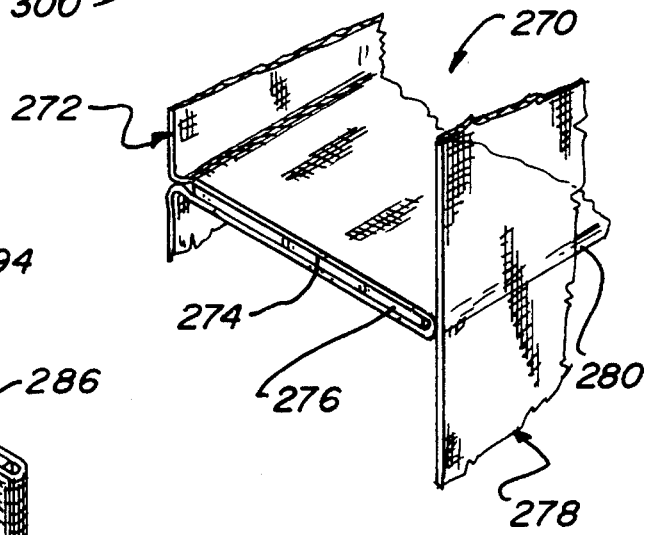
FIG. 51A is a fragmentary isometric view of a third arrangement of the second embodiment of the present invention wherein a second sheet is affixed to a rear edge of the vanes.

It will be appreciated that with any of the afore-described arrangements of the second embodiment, the vanes could have more than two fabric layers by forming multiple closely adjacent or contiguous folds 300 within one of which is inserted a rigid slat 302. An illustrative example of such an arrangement forming a variation off of the arrangement of FIG. 51A is shown in FIG. 51B.

It will be appreciated from the above noted description of various arrangements and embodiments of the present invention that a window covering has been described which includes at least one soft transparent or translucent sheet and a plurality of rigid parallel vanes projecting away from the sheet. The vanes can be formed in various ways and operated in various manners depending upon whether the vanes are horizontally or vertically oriented. It will be appreciated that the features described in connection with each arrangement of the invention are interchangeable to some degree so that many variations beyond those specifically described are possible.

Although the present invention has been described with a certain degree of particularity, it is understood that the present disclosure has been made by way of example, and changes in detail or structure may be made without departing from the spirit of the invention, as defined in the appended claims.

We claim:

1. A window covering comprising in combination, a flexible sheet of fabric material having a front face and a rear face, a plurality of parallel elongated fabric vanes having a longitudinal axis and forming variably directed flexible extensions from said rear face of said sheet, said fabric vanes having a stiffening compound impregnated into the fabric whereby said vanes retain a predetermined form, and control means for operably supporting said vanes and said sheet such that said sheet is suspended substantially vertically and for pivoting said vanes about said longitudinal axes so as to shift said window covering between an open condition wherein said vanes extend substantially perpendicularly to said sheet and a closed position wherein said vanes extend substantially parallel to said sheet.

2. The window covering of claim 1 wherein said vanes are formed from the same material as said sheet and form integral extensions from said sheet defining living hinges at the juncture of said sheet with the integral vanes.

3. The window covering of claim 2 wherein said vanes comprise loops of material formed off the rear face of said sheet and wherein layers of material defined by said loops are bonded together with said stiffening compound such that each vane is comprised of at least a double layer of said material.

4. The window covering of claim 3 wherein said vanes are compressed along said juncture to form a flex line along the juncture of said vanes with said sheet that is more flexible than the remainder of said vanes.

5. The window covering of claim 2 further including a second flexible sheet of fabric material having a front face and a rear face, said second flexible sheet extending substantially parallel to said first-mentioned flexible sheet with the front face of said second flexible sheet confronting the rear face of said first-mentioned flexible sheet, said vanes having an edge at an opposite side thereof from said juncture, said edge of said vanes being secured to said second flexible sheet.

6. The window covering of claim 5 wherein said vanes comprise loops of material formed off the rear face of said first-mentioned flexible sheet said loops having two layers of material and wherein said layers of material are bonded together with said stiffening compound such that each vane is comprised of at least a double layer of said material.

7. The window covering of claim 1 further including a second flexible sheet of fabric material having a front face and a rear face, said second flexible sheet extending substantially parallel to said first-mentioned flexible sheet with the front face of said second flexible sheet confronting the rear face of said first-mentioned flexible sheet, said vanes forming integral extensions from one of said sheets toward the other of said sheets and forming living hinges at the integral junctures with said sheets, each vane having an edge at an opposite side thereof from said living hinge, said edge of said vanes being secured to the flexible sheet to which the vane is not integrally connected.

8. The window covering of claim 7 wherein said vanes comprise loops of material defining two layers of material, said layers of material being bonded together with said stiffening compound.

9. The window covering of claim 7 wherein adjacent vanes are integrally formed from a different one of said fabric sheets.

10. The window covering of claim 1 further including a second flexible sheet of fabric material having a front face and a rear face, said second flexible sheet extending substantially parallel to said first-mentioned sheet with the front face of said second flexible sheet confronting the rear face of said first-mentioned flexible sheet, said vanes being of substantially planar configuration and formed of fabric material having two layers, said layers being bonded together with said stiffening compound, and wherein said vanes have opposite elongated side edges respectively flexibly secured to the front face of said second sheet and the rear face of said first-mentioned sheet.

11. A window covering comprising in combination, a flexible sheet of fabric material having a front face and a rear face, a plurality of parallel elongated fabric vanes having longitudinal axes, said vanes comprising loops of material formed from said sheet of material off the rear face of said sheet and substantially rigid slats confined in said loops of material, said loops of material having two spaced confronting layers which are secured together along a hinge line adjacent to said rear face of said sheet at the juncture of said vanes with said sheet, and a control system for operably supporting said vanes and sheet such that said sheet is suspended substantially vertically and for pivoting said vanes about said longitudinal axes so as to shift said window covering between an open condition wherein said vanes extend substantially perpendicularly to said sheet and a closed position wherein said vanes extend substantially parallel to said sheet.

12. The window covering of claim 11 further including a second flexible sheet of fabric material having a front face and a rear face, said second flexible sheet extending substantially parallel to said first-mentioned flexible sheet with the front face of said second flexible sheet confronting the rear face of said first-mentioned flexible sheet, said vanes having an edge opposite said hinge line, said edge being flexibly secured to said second flexible sheet.

13. A window covering comprising in combination first and second continuous flexible sheets of fabric material extending substantially parallel to each other with each having a front face and a rear face, the front face of said second sheet confronting the rear face of said first sheet, a plurality of parallel elongated vanes, said vanes comprising loops of material integrally formed from one or the other of said sheets of material and extending from the front face of said second sheet or the rear face of said first sheet toward the other of said sheets, and substantially rigid slats confined in said loops of material, said loops of material having two spaced confronting layers which are secured together along a hinge line adjacent to the sheet from which it is integrally formed and an edge opposite said hinge line flexibly connected to the sheet from which the vane is not integrally formed.

14. The window covering of claim 13 wherein adjacent vanes are integrally formed from a different one of said flexible sheets.

15. A window covering comprising in combination first and second flexible sheets of fabric material extending substantially parallel to each other with each sheet having a front face and a rear face, the front face of said second sheet confronting the rear face of said first sheet, a plurality of parallel elongated vanes, said vanes comprising independent elongated loops of fabric material and substantially rigid slats disposed within said loops, each vane having opposite side edges respectively flexibly connected to the front face of said second sheet and the rear face of said first sheet.

16. The window covering of claim 11 wherein said vanes extend horizontally and include openings therethrough at spaced intervals along their length, said control system including a plurality of cords, some of which are operably interconnected with said vanes through said openings.

17. The window covering of claim 16 wherein said cords are operative to pivot said vanes to move the window covering between the open and closed conditions and also to lift the vanes vertically while accumulating the vanes in a stacked relationship.

18. The window covering of claim 17 wherein said cords are interconnected with said vanes to selectively support the vanes at vertically spaced intervals.

19. The window covering of claim 11 wherein said vanes extend horizontally and have a rear edge on the opposite side of said vane form said hinge line, and said control system includes a plurality of cords operably connected to said vanes at the rear edges thereof, said cords being reciprocally moveable relative to said sheet to pivot the vanes between the open and closed positions of said window covering.

20. The window covering of claim 11 wherein said vanes extend horizontally and have a rear edge on the opposite side of said vane from said hinge line, and further including a second sheet of fabric material secured to said rear edges of said vanes, said second sheet extending in substantially parallel relationship to said first mentioned sheet and being reciprocally moveable relative to said first mentioned sheet to pivot the vanes between the open and closed positions of said window covering.

21. The window covering of claims 11, 16, 19 or 20 wherein said sheet or sheets of material are translucent or transparent and said vanes are substantially opaque.

22. The window covering of claim 3 wherein there are a plurality of said loops in each vane.

23. The window covering of claim 13 wherein there are a plurality of said loops in each vane and one slat in one of said loops of each vane.

* * * * *